US009714510B2

(12) United States Patent
Castonguay et al.

(10) Patent No.: US 9,714,510 B2
(45) Date of Patent: Jul. 25, 2017

(54) WALL ASSEMBLY

(71) Applicant: LES MATERIAUX DE CONSTRUCTION OLDCASTLE CANADA INC., St. John (CA)

(72) Inventors: Bertin Castonguay, Magog (CA); Robert Declos, Montreal (CA); Joel Remillard, Terrebonne (CA); John Penterman, Montreal (CA)

(73) Assignee: Les Materiaux de Construction Oldcastle Canada Inc., St. John (CA)

( * ) Notice: Subject to any disclaimer, the term of this patent is extended or adjusted under 35 U.S.C. 154(b) by 0 days.

(21) Appl. No.: 14/188,214

(22) Filed: Feb. 24, 2014

(65) Prior Publication Data

US 2014/0298747 A1 Oct. 9, 2014

Related U.S. Application Data

(60) Provisional application No. 61/768,858, filed on Feb. 25, 2013.

(51) Int. Cl.
*E04B 2/44* (2006.01)
*E02D 29/02* (2006.01)
(Continued)

(52) U.S. Cl.
CPC ..... *E04B 2/44* (2013.01); *E02D 29/02* (2013.01); *E04C 1/395* (2013.01); *E04B 2002/0234* (2013.01)

(58) Field of Classification Search
CPC ..... E04B 2/40; E04B 2/44; E04B 2/54; E04B 2/02; E04B 2/8652; E04B 2002/0206; E02D 29/02; E04C 1/395
(Continued)

(56) References Cited

U.S. PATENT DOCUMENTS 738,643 A 9/1903 Van Camp
791,291 A * 5/1905 Roberts ..... 52/781.3
(Continued)

FOREIGN PATENT DOCUMENTS

CA 2258637 A1 8/1999
CA 2367664 A1 11/2000
(Continued)

OTHER PUBLICATIONS

United States Office Action dated Nov. 6, 2014, U.S. Appl. No. 12/752,766.

(Continued)

*Primary Examiner* — Babajide Demuren
(74) *Attorney, Agent, or Firm* — Borden Ladner Gervais LLP

(57) ABSTRACT

Disclosed is a wall assembly including preformed building blocks and a trellis type support member for maintaining the building blocks in place in the desired orientation. The wall assembly further includes at least one support for holding the trellis upright. The individual blocks are connected to the supporting trellis for added stability. Although not every block in the wall need be connected to the trellis support member in order to achieve the desired added stability, it is preferred to connect each block in the wall to the trellis. Connectors are provided for connecting the blocks to the trellis. Each block preferably is connected to the trellis by at least one connector, most preferably by a pair of connectors. To accommodate relative movement or shifting of the blocks during installation and in situ, the connectors are preferably movably connected to the trellis or the block, or both.

20 Claims, 47 Drawing Sheets

(51) Int. Cl.
*E04C 1/39* (2006.01)
*E04B 2/02* (2006.01)

(58) Field of Classification Search
USPC ..... 52/438, 477, 479, 481.1, 481.2, 483.1, 52/489.1, 474; 405/262, 284
See application file for complete search history.

(56) References Cited

U.S. PATENT DOCUMENTS

| | | | | |
|---|---|---|---|---|
| 1,033,988 | A | | 7/1912 | Coburn |
| 1,214,964 | A | | 2/1917 | Small |
| 1,226,214 | A | | 5/1917 | Hopkins |
| 1,345,156 | A | | 6/1920 | Flynn |
| 1,472,917 | A | | 11/1923 | Laird |
| 1,567,085 | A | | 12/1925 | Rowland |
| 1,624,369 | A | | 4/1927 | Serra |
| 1,907,053 | A | | 5/1933 | Flath |
| 1,943,800 | A | | 1/1934 | Morrison |
| 1,953,005 | A | | 3/1934 | Nagel |
| 2,049,907 | A | | 8/1936 | Hess |
| 2,061,822 | A | | 11/1936 | Bankert |
| 2,225,612 | A | | 12/1940 | Allen |
| 2,392,551 | A | | 1/1946 | Roe |
| 2,544,488 | A | | 3/1951 | Chittenden |
| 2,929,238 | A | | 3/1960 | Kaye |
| 3,353,312 | A | | 11/1967 | Storch |
| 3,391,507 | A | | 7/1968 | Downing |
| 3,546,833 | A | | 12/1970 | Perreton |
| 3,607,643 | A | | 9/1971 | Paget |
| 3,609,926 | A | | 10/1971 | Muse |
| 3,786,605 | A | | 1/1974 | Winfrey |
| 3,854,256 | A | | 12/1974 | Wilce |
| 3,877,236 | A | | 4/1975 | Newell et al. |
| 4,068,482 | A | | 1/1978 | Hilfiker |
| 4,164,598 | A | | 8/1979 | Wilhelm |
| 4,229,922 | A | | 10/1980 | Clark, Jr. |
| 4,285,181 | A | | 8/1981 | Van Loghem et al. |
| 4,348,847 | A | | 9/1982 | Jukes |
| 4,391,077 | A | | 7/1983 | Giess |
| 4,438,605 | A | | 3/1984 | DeLucia |
| 4,442,644 | A | | 4/1984 | Jukes |
| 4,478,021 | A | | 10/1984 | Person |
| 4,490,075 | A | | 12/1984 | Risi et al. |
| 4,498,266 | A | | 2/1985 | Perreton |
| 4,532,747 | A | | 8/1985 | Koetje |
| 4,545,703 | A | | 10/1985 | Boynton |
| 4,589,241 | A | | 5/1986 | Volpenhein |
| 4,596,102 | A | | 6/1986 | Catani et al. |
| 4,597,236 | A | | 7/1986 | Braxton |
| 4,655,014 | A | | 4/1987 | Krecke |
| 4,700,523 | A | | 10/1987 | Kohara |
| 4,774,791 | A | | 10/1988 | Kafarowski |
| 4,825,619 | A | | 5/1989 | Forsberg |
| 4,833,856 | A | | 5/1989 | Zwagerman |
| 4,835,928 | A | | 6/1989 | Scott |
| 4,866,891 | A | | 9/1989 | Young |
| 4,914,887 | A | * | 4/1990 | Meheen ..... 405/284 |
| 4,949,515 | A | | 8/1990 | Krecke |
| 4,956,949 | A | | 9/1990 | Francis |
| 4,967,528 | A | | 11/1990 | Doran |
| 5,033,912 | A | | 7/1991 | Vidal |
| 5,140,794 | A | | 8/1992 | Miller |
| 5,154,542 | A | | 10/1992 | Klenert |
| 5,161,918 | A | | 11/1992 | Hodel |
| 5,214,898 | A | | 6/1993 | Beretta |
| 5,315,802 | A | | 5/1994 | Hart |
| 5,350,256 | A | | 9/1994 | Hammer |
| 5,370,480 | A | | 12/1994 | Quaney |
| 5,403,127 | A | | 4/1995 | Knudsen |
| 5,435,111 | A | | 7/1995 | Cox et al. |
| 5,468,098 | A | | 11/1995 | Babcock |
| 5,472,297 | A | * | 12/1995 | Heselden ..... 405/286 |
| 5,474,405 | A | | 12/1995 | Anderson et al. |
| 5,489,074 | A | | 2/1996 | Arnold et al. |
| 5,501,049 | A | | 3/1996 | Francis et al. |
| 5,505,563 | A | | 4/1996 | Curt |
| 5,513,475 | A | | 5/1996 | Schaaf et al. |
| 5,570,552 | A | | 11/1996 | Nehring |
| 5,586,841 | A | | 12/1996 | Anderson et al. |
| 5,647,166 | A | * | 7/1997 | Neff ..... 47/45 |
| 5,647,695 | A | * | 7/1997 | Hilfiker et al. ..... 405/284 |
| 5,673,530 | A | | 10/1997 | Bailey, II |
| 5,688,078 | A | | 11/1997 | Hammer |
| 5,707,184 | A | | 1/1998 | Anderson et al. |
| 5,735,643 | A | | 4/1998 | Castonguay et al. |
| 5,788,423 | A | | 8/1998 | Perkins |
| 5,845,448 | A | | 12/1998 | Potvin |
| 5,851,088 | A | | 12/1998 | Anderson et al. |
| 5,930,947 | A | | 8/1999 | Eckhoff |
| 5,934,039 | A | | 8/1999 | Guy |
| 5,957,744 | A | | 9/1999 | Mott et al. |
| 5,983,585 | A | | 11/1999 | Spakousky |
| 6,024,517 | A | | 2/2000 | Castonguay et al. |
| 6,062,772 | A | | 5/2000 | Perkins |
| 6,176,059 | B1 | | 1/2001 | Cantarano et al. |
| 6,189,282 | B1 | | 2/2001 | VanderWerf |
| 6,238,144 | B1 | | 5/2001 | Babcock |
| 6,240,692 | B1 | | 6/2001 | Yost et al. |
| 6,622,445 | B1 | | 9/2003 | Shillingburg et al. |
| 6,637,167 | B2 | | 10/2003 | Hanna |
| 6,662,520 | B1 | * | 12/2003 | Nelson ..... 52/474 |
| 6,701,687 | B1 | | 3/2004 | Shillingburg |
| 6,874,291 | B1 | | 4/2005 | Weber |
| 6,880,297 | B2 | | 4/2005 | Johnston |
| 6,912,823 | B2 | | 7/2005 | MacDonald et al. |
| 6,935,081 | B2 | | 8/2005 | Dunn et al. |
| 6,953,309 | B1 | | 10/2005 | Tufts et al. |
| 6,978,581 | B1 | | 12/2005 | Spakousky |
| 7,198,435 | B2 | | 4/2007 | Dolan et al. |
| 7,410,328 | B2 | | 8/2008 | Hamel |
| 7,464,509 | B1 | | 12/2008 | Brown |
| 7,503,729 | B2 | | 3/2009 | Hammer et al. |
| 7,591,447 | B2 | | 9/2009 | Hammer et al. |
| 7,827,752 | B2 | | 11/2010 | Scherrer |
| 8,206,065 | B2 | * | 6/2012 | Heselden ..... 405/284 |
| 8,596,926 | B2 | * | 12/2013 | Heselden ..... 405/284 |
| 8,689,501 | B2 | * | 4/2014 | Chamoux ..... 52/173.1 |
| 8,777,514 | B2 | * | 7/2014 | Heselden ..... 405/17 |
| 8,851,803 | B2 | | 10/2014 | Bott |
| 9,151,051 | B2 | | 10/2015 | Cossette et al. |
| 9,234,347 | B2 | | 1/2016 | Cossette et al. |
| 2001/0029717 | A1 | | 10/2001 | Spakousky et al. |
| 2002/0124508 | A1 | | 9/2002 | Dunn et al. |
| 2003/0126821 | A1 | | 7/2003 | Scherer et al. |
| 2003/0140585 | A1 | | 7/2003 | Dueck et al. |
| 2003/0159378 | A1 | | 8/2003 | Johnston |
| 2003/0182011 | A1 | | 9/2003 | Scherer |
| 2005/0120670 | A1 | | 6/2005 | Ness et al. |
| 2006/0110223 | A1 | | 5/2006 | Dawson et al. |
| 2006/0179779 | A1 | | 8/2006 | Ness |
| 2007/0196184 | A1 | | 8/2007 | Hammer et al. |
| 2007/0266656 | A1 | | 11/2007 | Blocken |
| 2008/0057801 | A1 | | 3/2008 | Duffy |
| 2008/0236084 | A1 | | 10/2008 | Pontarolo |
| 2009/0013629 | A1 | | 1/2009 | Boeshart |
| 2009/0041552 | A1 | | 2/2009 | Hammer |
| 2009/0308011 | A1 | | 12/2009 | Phillippe |
| 2011/0217127 | A1 | | 9/2011 | Macdonald |
| 2012/0060438 | A1 | * | 3/2012 | Jensen ..... 52/438 |
| 2012/0073229 | A1 | | 3/2012 | Castonguay et al. |
| 2012/0117904 | A1 | | 5/2012 | Bouchard et al. |
| 2013/0081353 | A1 | * | 4/2013 | Jensen ..... 52/742.1 |
| 2014/0215949 | A1 | | 8/2014 | Cossette et al. |
| 2015/0218806 | A1 | | 8/2015 | Cossette et al. |
| 2016/0024786 | A1 | | 1/2016 | Castonguay et al. |
| 2016/0186433 | A1 | | 6/2016 | Cossette et al. |

FOREIGN PATENT DOCUMENTS

| | | | |
|---|---|---|---|
| CA | 2447646 | A1 | 11/2002 |
| CA | 2485870 | A1 | 11/2003 |
| CA | 2544152 | A1 | 10/2006 |
| CA | 2550359 | A1 | 12/2007 |
| CN | 2353796 | Y | 12/1999 |

(56) References Cited

FOREIGN PATENT DOCUMENTS

| | | | |
|---|---|---|---|
| DE | 2549162 | A1 | 5/1977 |
| DE | 4134439 | A1 | 4/1993 |
| DE | 10110798 | A1 | 2/2002 |
| DE | 202008012263 | U1 | 11/2008 |
| FR | 2583808 | A1 | 12/1986 |
| FR | 2740488 | A1 | 4/1997 |
| JP | 58156637 | A1 | 9/1983 |
| KR | 10-2011-0011074 | A | 2/2011 |
| NL | 1024629 | C1 | 11/2004 |
| WO | 2008092237 | A1 | 8/2008 |

OTHER PUBLICATIONS

United States Notice of Allowance dated Nov. 18, 2014, U.S. Appl. No. 13/247,633.
International Application No. PCT/CA2007/002351, International Search Report dated Apr. 1, 2008, 28 pages.
U.S. Appl. No. 13/247,633, Office Action dated Mar. 20, 2013, 24 pages.
U.S. Appl. No. 12/752,766, Office Action dated Jan. 18, 2013, 25 pages.
U.S. Appl. No. 13/247,633, Office Action dated Jan. 13, 2014, 17 pages.
Canadian Patent Application No. 2,676,369, Office Action dated Nov. 28, 2013, 3 pages.
U.S. Appl. No. 12/525,491, Office Action dated Mar. 6, 2013, 17 pages.
U.S. Appl. No. 12/752,766, Office Action dated Jul. 18, 2013, 22 pages.
U.S. Appl. No. 12/525,491 Office Action dated Jul. 19, 2011, 23 pages.
U.S. Appl. No. 12/525,491, Office Action dated Aug. 29, 2013, 11 pages.
U.S. Appl. No. 12/525,491, Office Action dated Dec. 22, 2011, 15 pages.
U.S. Appl. No. 12/525,491, Office Action dated Jul. 5, 2013, 13 pages.
International Patent Application No. PCT/CA2011/050608, International Search Report dated Nov. 4, 2011, 8 pages.
International Patent Application No. PCT/CA2014/050129, International Search Report dated May 8, 2014, 9 pages.
U.S. Appl. No. 12/525,491, Office Action dated Apr. 21, 2014, 23 pages.
U.S. Appl. No. 12/752,766, Office Action dated Apr. 25, 2012, 29 pages.
U.S. Appl. No. 14/625,107, Office Action dated Jun. 10, 2015.
U.S. Appl. No. 12/752,766, Notice of Allowance dated Jul. 31, 2015.
U.S. Appl. No. 14/625,107, Notice of Allowance dated May 4, 2016.
U.S. Appl. No. 14/876,871, Notice of Allowance dated Jun. 10, 2016.
U.S. Appl. No. 14/625,107, Supplemental Notice of Allowability dated Jul. 8, 2016.
European Application No. 14754912.5, Extended European Search Report dated Nov. 10, 2016, 7 pages.
U.S. Appl. No. 15/216,219, Office Action dated Nov. 1, 2016, 13 pages.
Office Action dated Oct. 27, 2016 issued on the corresponding U.S. Appl. No. 14/994,953.
U.S. Appl. No. 14/994,953, Notice of Allowance dated Feb. 22, 2017.
U.S. Appl. No. 15/267,719, Office action dated Feb. 8, 2017.
U.S. Appl. No. 15/216,219, Office Action dated Apr. 13, 2017.
Australian Patent Application No. 2016204263, Examination Report No. 1 dated Apr. 18, 2017.

* cited by examiner

WALL ASSEMBLY

CROSS REFERENCE TO RELATED APPLICATIONS

This application claims the benefit of priority of U.S. Provisional Patent Application No. 61/768,858 filed Feb. 25, 2013 which is incorporated herein by reference in its entirety.

FIELD OF THE INVENTION

This application relates to wall structures and is directed more particularly to a wall assembly for a freestanding wall, or freestanding accessories such as a column, or structures of other shape, which may be constructed of a plurality of stacked blocks, without mortar.

DESCRIPTION OF THE PRIOR ART

Mortarless freestanding walls or retaining walls made of stacked rows of solid or hollow blocks are generally known. Such walls often include interlocking features between the blocks or reinforcing structures placed within the stacked blocks or between the stacked rows. Lattice type structures are sometimes used for providing rigidity to the wall or for interlocking successive rows of stacked blocks (U.S. Pat. No. 3,546,833; U.S. Pat. No. 2,929,238; U.S. Pat. No. 4,229,922).

Other wall assemblies are known which use combinations of different blocks to form the wall. Base blocks are used for forming the wall and the wall is provided with a decorative finish by attaching decorative facing panels to the stacked base blocks.

In another known wall assembly, the wall is made of facing panels only, which are in and of themselves of insufficient width to form a freestanding wall, but are stacked and connected back to back to provide the required width for the wall. The thin facing panels are much lighter than conventional wall blocks and easier to handle, but harder to install, due to their inherent instability. In one back to back assembly, spacers are used to both connect the facing panels at the back and to create an intermediate space which can be filled with granular filler material to increase the mass and stability of the wall.

All of those known wall assemblies require skill to ensure the wall blocks are stacked or assembled in the desired orientation (straight or curved) and level. Back to back assemblies are the most difficult to assemble, since not only must the rows in the respective walls be aligned for back to back connection of the blocks, but the retaining grooves must be aligned as well. Furthermore, due to changes in the base supporting the wall, such as settling or buckling of the base on which the wall is stacked, the stacked blocks may shift due to the lack of mortar and the wall may buckle or lean and may even topple over with time. To straighten out buckled or leaning walls, the wall must be torn down and reassembled at significant cost in time and effort. Thus, a need exists for a more stable wall assembly by which wall structures, and the like, may be quickly and easily erected, without the use of mortar, allowing a reduction in expense of skilled labor.

SUMMARY OF THE INVENTION

An object of the present disclosure is to provide a wall assembly, which can be easily and quickly assembled without the need for mortar, cement, or the like to achieve structural integrity.

A further object of the disclosure is to provide a wall assembly including preformed building blocks and a trellis type member for maintaining the building blocks in place in the desired orientation. The wall assembly further includes at least one support for holding the trellis upright. The individual blocks are connected to the supporting trellis for added stability. Although not every block in the wall need be connected to the trellis support member in order to achieve the desired added stability, if maximum stability is to be achieved, it is preferred to connect each block in the wall to the trellis. Connectors are provided for connecting the blocks to the trellis. Each block preferably is connected to the trellis by at least one connector, most preferably by a pair of connectors. Although the connection of the blocks to the trellis obviates the need for mortar or cement for structural integrity, it may still be desired to use mortar or grout for aesthetic or sealing purposes.

To accommodate relative movement or shifting of the blocks during installation and in situ, the connectors are preferably movably connected to the trellis or the block, or both. Moreover, the connectors may include a joint allowing different relative orientations of the ends connecting to the block and trellis respectively. Although this allows the blocks to shift relative to one another and relative to the trellis, buckling, leaning and toppling of the wall is avoided, since the combination of the blocks with the trellis panel and the support results in an overall rigid structure and the trellis panel and support maintain the structure in the desired upright orientation. In other words, the trellis panel functions as a rigid backbone for the wall of loosely stacked facing blocks. For added adaptability of the overall structure to shifting or sagging of the blocks, the connectors may include a pair of rotatable joints whereby the axes of rotation can be orthogonal to one another for maximum flexibility of movement.

By attaching the blocks to be movable relative to and along the trellis panel and/or the connectors, the options for design and pattern of the wall are vastly increased, since the blocks need not be stacked according to a specific pitch or pattern and blocks of different size and shape can be combined within the same wall. This allows for the creation of irregular installation patterns which much more closely approximate the appearance of a natural stone wall. The blocks may even be stacked in varying orientations within the same wall and combined with blocks of different size and shape to create a tessellation pattern in the wall. Moreover, the flexibility of placement of the blocks relative to the trellis panel and relative to one another allows for insertion into the wall of accent or accessory parts other than blocks. Such inserts may include different materials, for example wood or glass and may even be used to create gaps or openings in the wall. The wall blocks may be wet cast or dry cast concrete blocks, natural stone blocks, or other man made blocks.

Because of the backbone function of the trellis, the size of the facing blocks can be significantly reduced, which facilitates handling and installation of the blocks. In order to prevent toppling of a standard stacked wall, the stacked wall blocks generally require a certain minimum size in direction of the wall thickness, the minimum width of the blocks. However, with the wall assembly in accordance with the present disclosure, wall blocks or facing blocks can be used which have a width much below this minimum width and preferably even fraction of the minimum width. This significantly facilitates handling and installation of the blocks, reduces the overall weight of the finished wall, which reduces the cost for preparing the footing for the wall and, most importantly, reduces material cost. Thus, the trellis support member not only holds the blocks in place to reduce buckling or leaning of the wall, it also allows for the use of much thinner blocks, which on their own could not be used to form a wall, since they would too easily topple over when stacked. This renders the wall assembly of this disclosure more economical than known stacked walls.

Double sided walls with blocks stacked back to back can also be assembled by connecting the blocks of each wall to the same trellis panel. Since the trellis panel in this arrangement forms a bridge between the respective walls, the blocks in one wall can differ in size, shape and orientation from those of the other wall, especially when jointed connectors are used. This allows for the creation of freestanding walls with different appearance on each side. Using connectors that space the blocks away from the trellis allows for the assembly of hollow walls and the option of filling the wall with loose filler material, for example gravel.

With the above and other objects in view, as will hereinafter appear, a feature of the present disclosure is the provision of a wall assembly comprising a trellis support panel, a plurality of building blocks, each of the building blocks having a facing surface, a rear surface, and at least one connector for connecting the rear surface of at least one of the stacked blocks to the trellis support member, whereby the trellis support member is adapted to hold the plurality of building blocks in the desired orientation vertically, horizontally, or in any other orientation, to form a wall structure.

The above and other features of the invention, including various novel details of construction and combinations of parts, will now be more particularly described with reference to the accompanying drawings and pointed out in the claims. It will be understood that the particular devices embodying the invention are shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention from which its novel features and advantages will be apparent.

In the drawings.

DETAILED DESCRIPTION OF THE PREFERRED EMBODIMENTS

Figure 1:
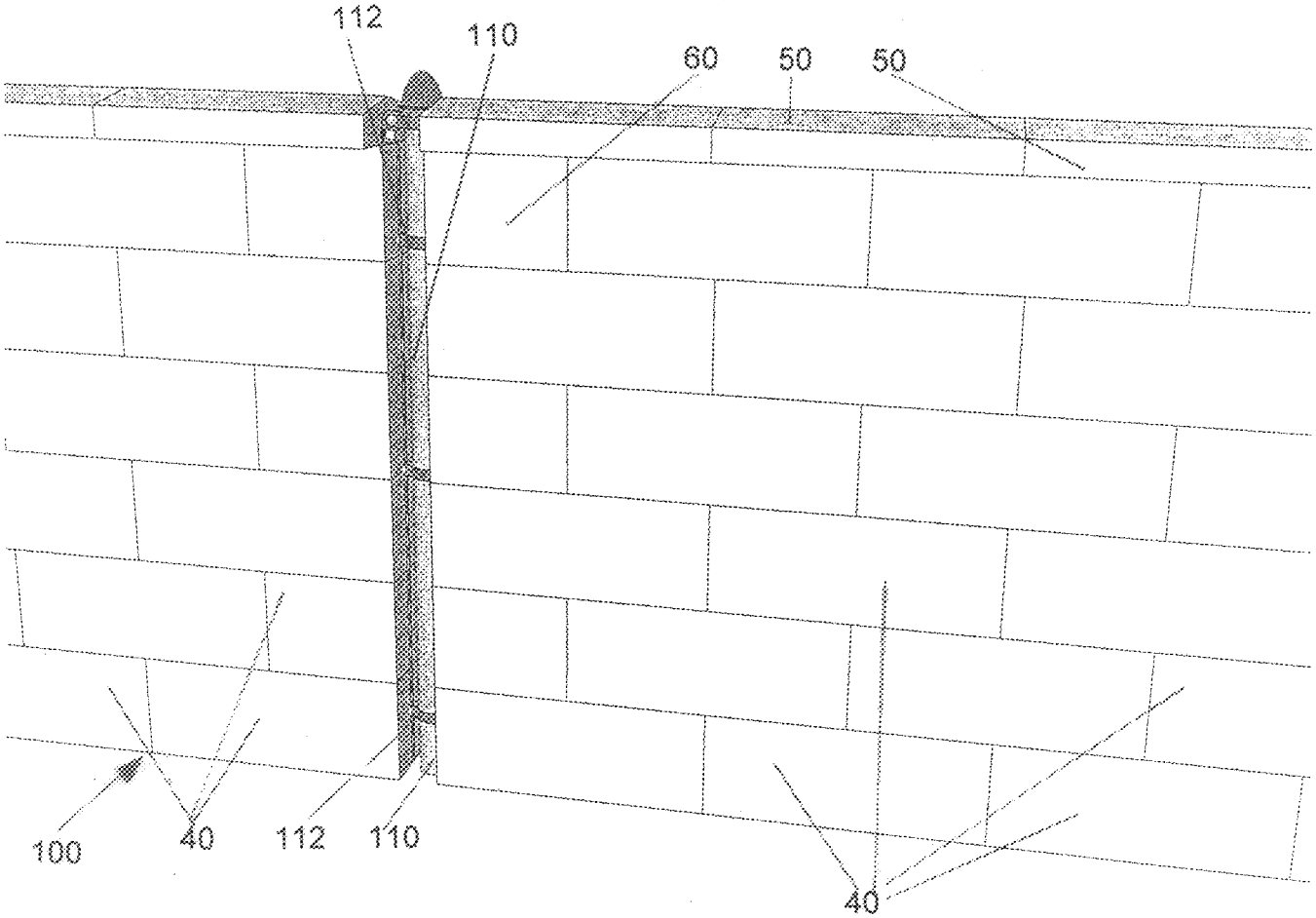
FIG. 1 is an elevational view of one exemplary wall assembly in accordance with this disclosure.

In the most basic wall assembly embodiment in accordance with this disclosure, as shown in FIGS. 1 to 4, the wall assembly 100 includes an upright trellis panel 20; a plurality of facing blocks 40 stacked into a facing wall 60; and a plurality of connectors 80 for connecting the facing blocks 40 to the trellis panel 20 in the stacked condition. A support 110 can be connected to the trellis panel 20 by fasteners 112 for holding the trellis panel 20 in the upright orientation. In the illustrated example, the support 110 is a post, but any other suitable vertical support structure can be used. For maximum stability, the trellis panel 20 is preferably connected to at least two spaced apart vertical support structures, such as posts 110. One or more additional trellis panels can be connected to the trellis panel to function as the vertical support structures.

The trellis panel 20 is generally an open framework or lattice of intersecting and interconnected mounting members 23 and support members 24 oriented at right angles to one another. When the trellis panel is in the upright orientation, the mounting members 23 can be oriented horizontally as illustrated in FIGS. 2-4, 6-9, 12 and 13, or vertically, as illustrated in FIGS. 14-16E, depending on the type of connector used.

In the exemplary assembly of FIGS. 1-4, the support members 24 maintain the mounting members 23 at a fixed spacing and at a horizontal orientation to permit mounting of the connectors 80 onto the mounting members 23 during installation. The vertical spacing of the mounting members 23 is preferably equal to the height of the facing blocks to be connected thereto. Preferably, the mounting and support members are interconnected rods, preferably welded together at their intersections. Preferably, the rods are metal rods. The metal rods may be provided with an corrosion reducing finish, may be galvanized or may be made of stainless steel In a modified exemplary assembly as shown in FIGS. 14-16E, maintain the mounting members 23 the mounting members are constructed as mounting rails which are placed at a fixed spacing and at a vertical orientation and at the same time function as the connectors for the facing blocks 40, to permit mounting of the facing blocks 40 directly onto the mounting members 23. The incorporated connectors of the mounting members 23 are shown in FIGS. 16A-16E. Preferably, the mounting members 23 are vertical mounting rails and the intersecting, horizontal support members 24 are connecting rods. The mounting rails and connecting rods are preferably made of metal, and welded or soldered together at their intersections.

As illustrated in FIGS. 3-9, the facing blocks 40 are provided in their rear face 42 with one or more retaining grooves. The shape of the retaining grooves 44 can be chosen arbitrarily, as long as it permits insertion, by sliding or clicking, of a connector 80 into the groove and resists removal of the connector from the groove in a direction perpendicular to the rear face 42. In the illustrated, exemplary embodiment, the retaining groove 44 is in the shape of a keyhole slot. Slots of other shapes, such as dovetail or recessed can also be used, or any other slot shape ensuring a reliable interconnection with the connector shape.

Figure 3:
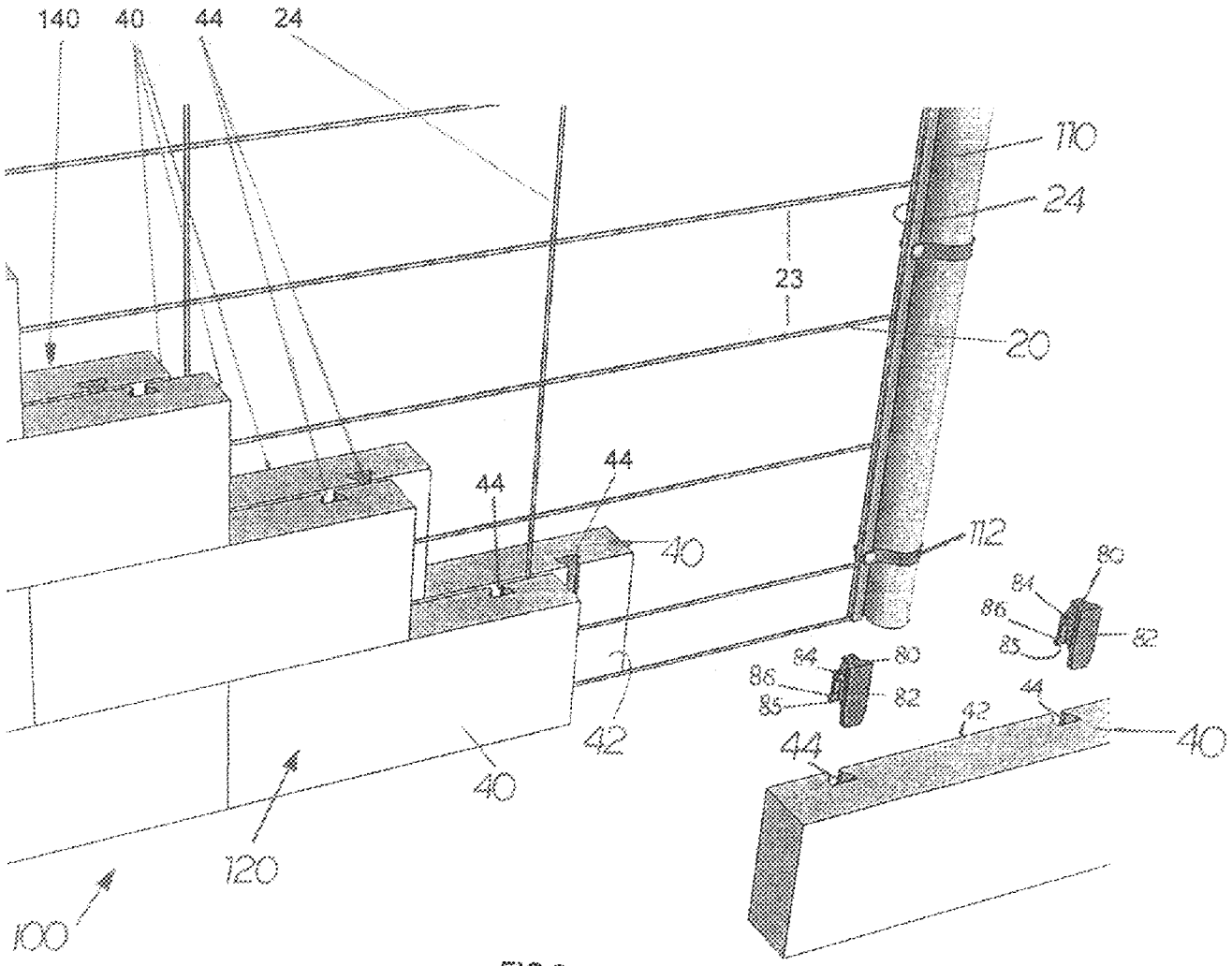
FIG. 3 is a detail view of FIG. 2 as seen from behind with an inserted connector.
Figure 4:
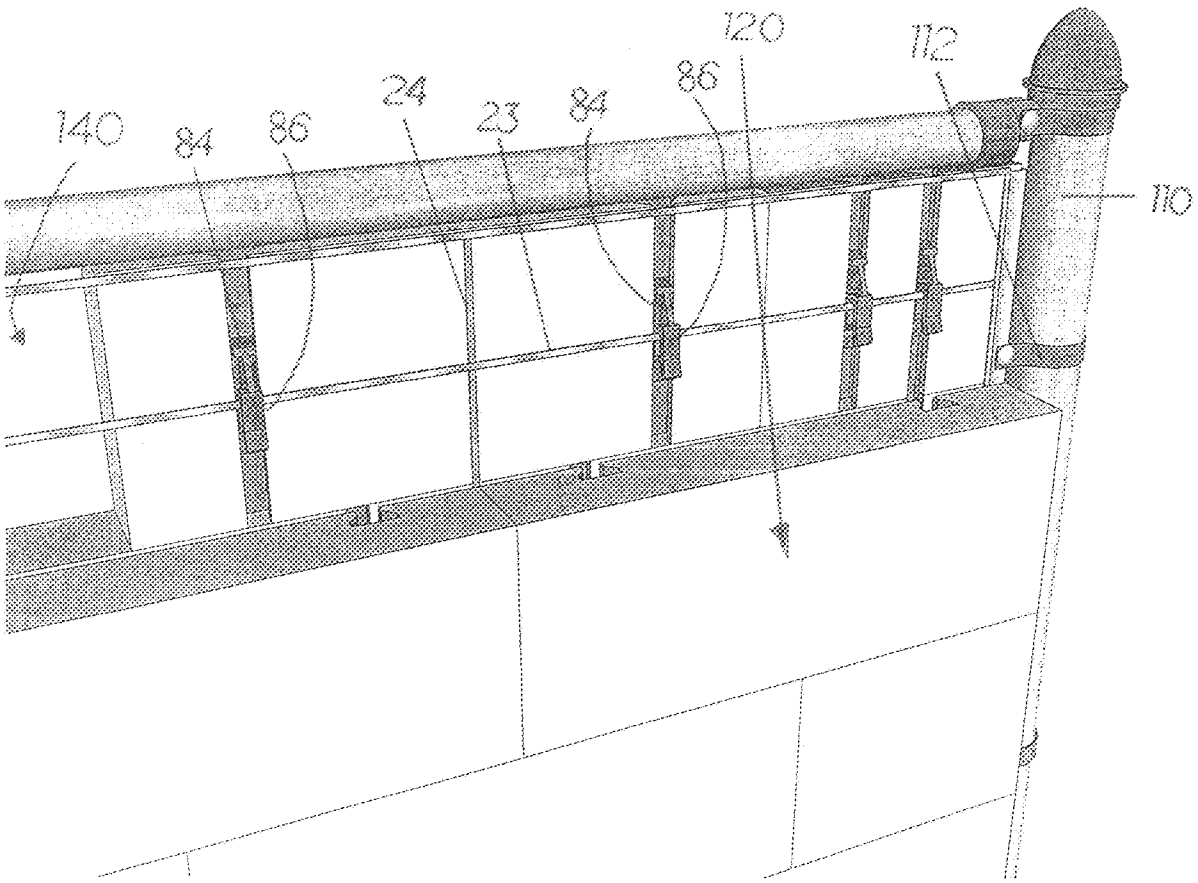
FIG. 4 is a detail view of the top end of the exemplary wall assembly of FIG. 1 in partially assembled condition.
Figure 5:
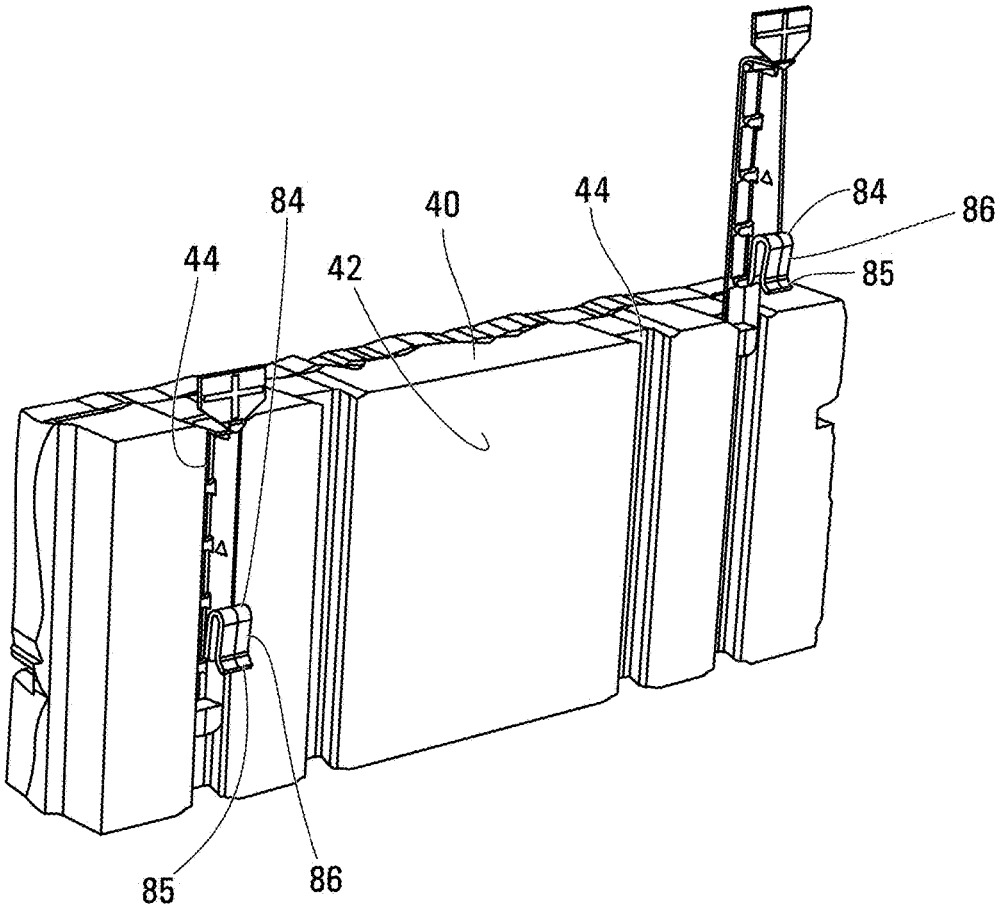
FIG. 5 is a perspective view from behind of one of the facing blocks used in the exemplary wall of FIG. 1.

The connectors 80 are shaped to reliably engage the retaining groove 44 and to resist extraction from the groove in a direction perpendicular to the rear face 42. The connector 80 can have a retaining portion 82 shaped to interlock with the retaining groove 44 and can be of a shape complementary to that of the groove, while being sized to facilitate insertion into the groove. The connector 80 further includes an attachment portion 84 for engagement of one of the mounting members 23 of the trellis panel 20. The engagement with the mounting member can be rigid and permanent, but is preferably slidable and most preferably slidable and releasable. In the exemplary embodiment as illustrated in FIGS. 3-5 the attachment portion 84 is in the shape of a hook 86 for fitting engagement of the mounting member 23. In an alternate exemplary embodiment, the attachment portion 84 is in the shape of a snap-on hook 85 resisting removal from the mounting member 23, once snapped on.

Figure 6:
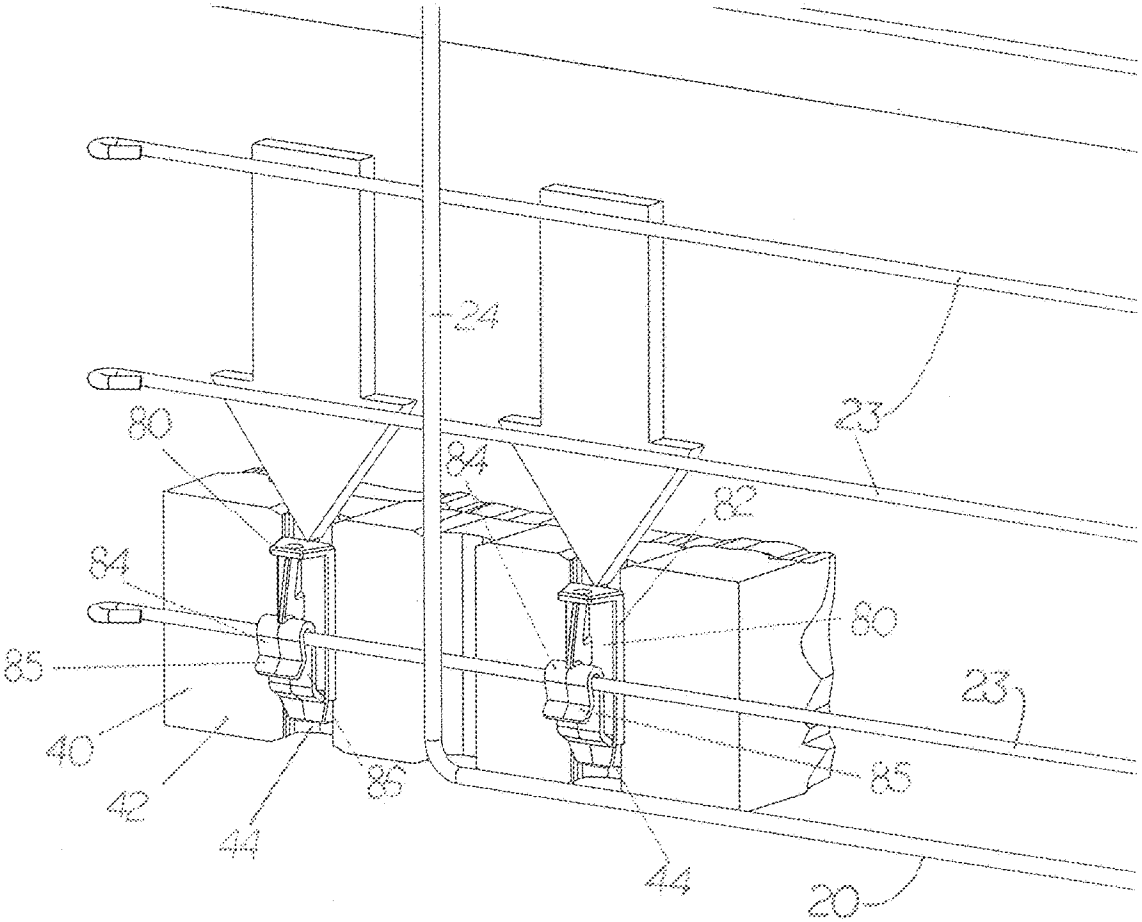
FIG. 6 is an elevational rear view of a trellis panel and facing block combination in accordance with the present disclosure at the point of installation of the connectors for connecting the facing block to the trellis panel.
Figure 7:
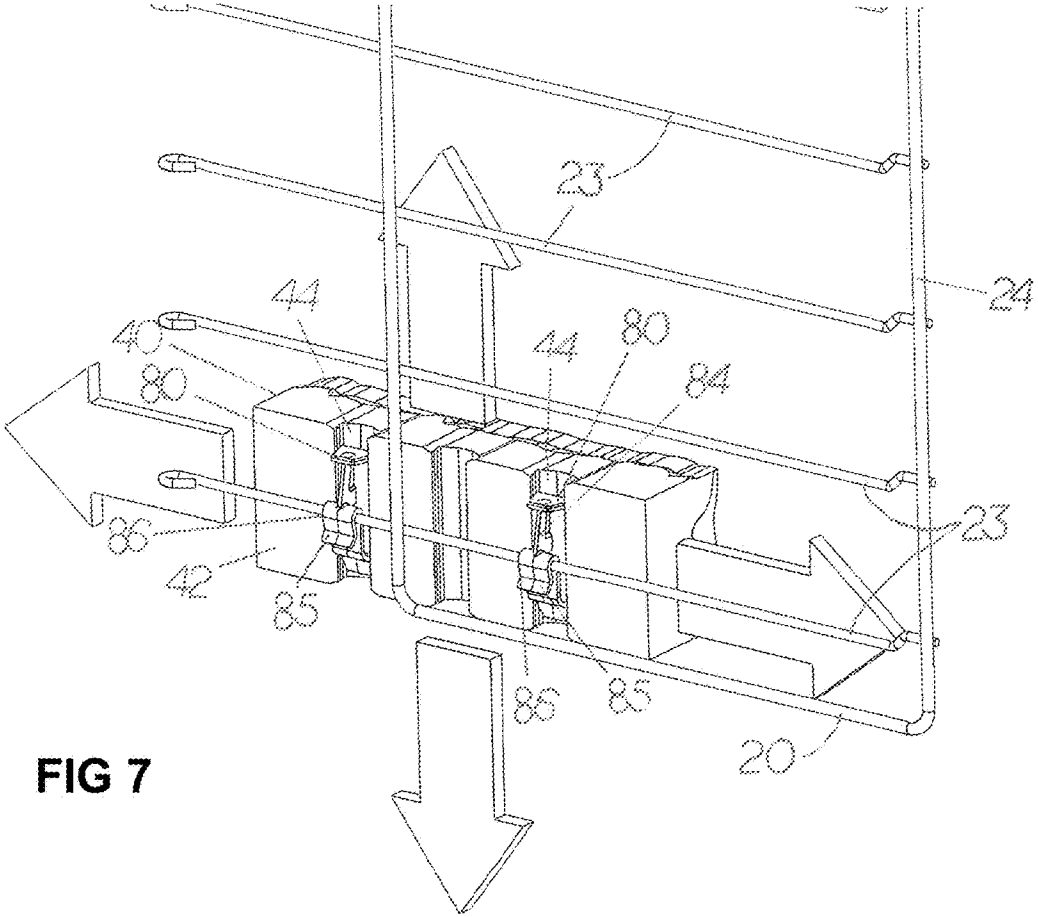
FIG. 7 is an elevational rear view of the trellis panel and facing block combination of FIG. 6 showing the connectors fully installed and illustrating the degrees of freedom of movement of an installed facing block.
Figure 8:
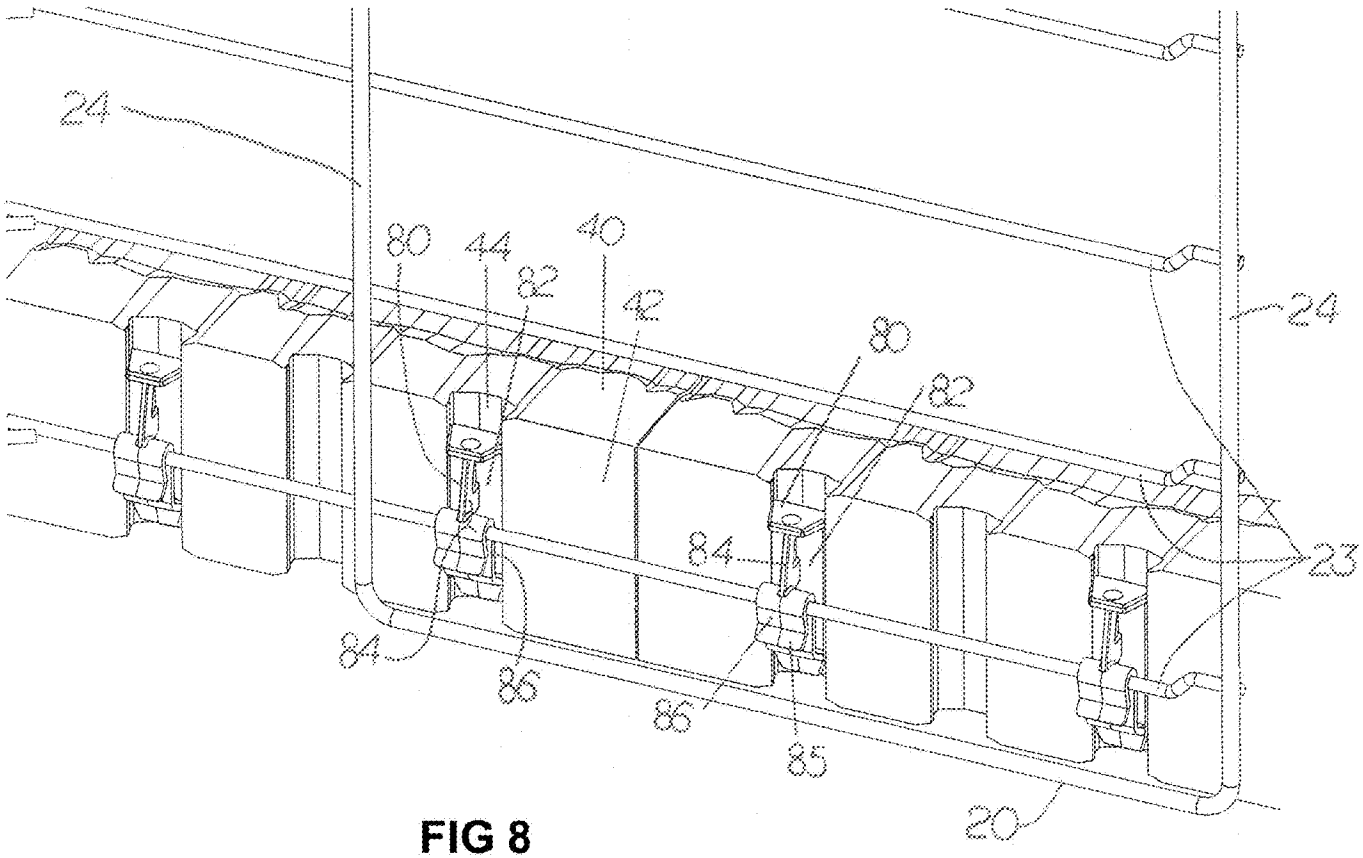
FIG. 8 is an elevational rear view of a trellis panel and facing block combination in accordance with the present disclosure showing the first row of facing blocks fully installed.
Figure 9:
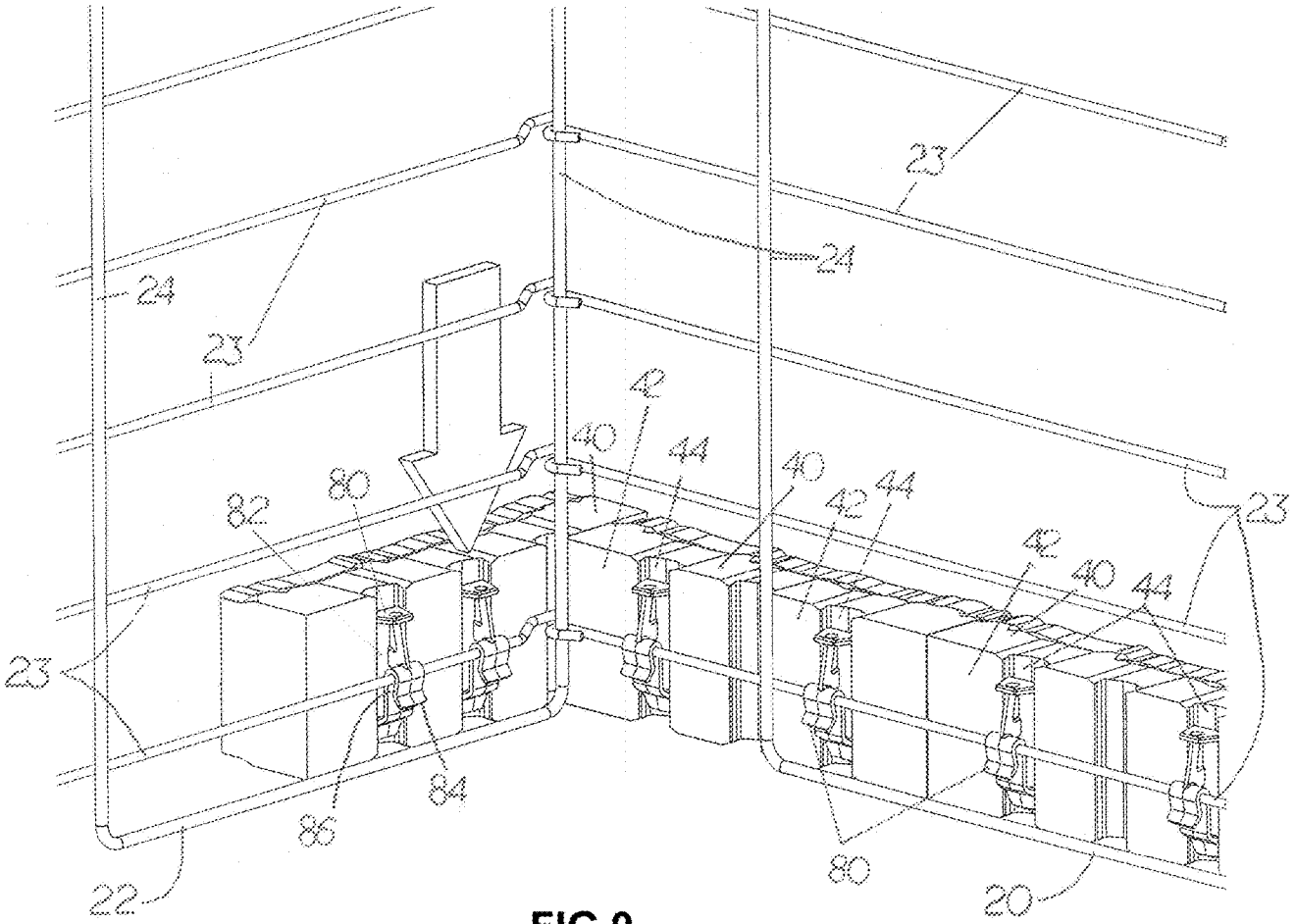
FIG. 9 is an elevational rear view of a trellis panel and facing block combination in accordance with the present disclosure, wherein a pair of trellis panels are connected to form a wall corner and facing blocks are connected to the trellis panels at the corner.
Figure 10:
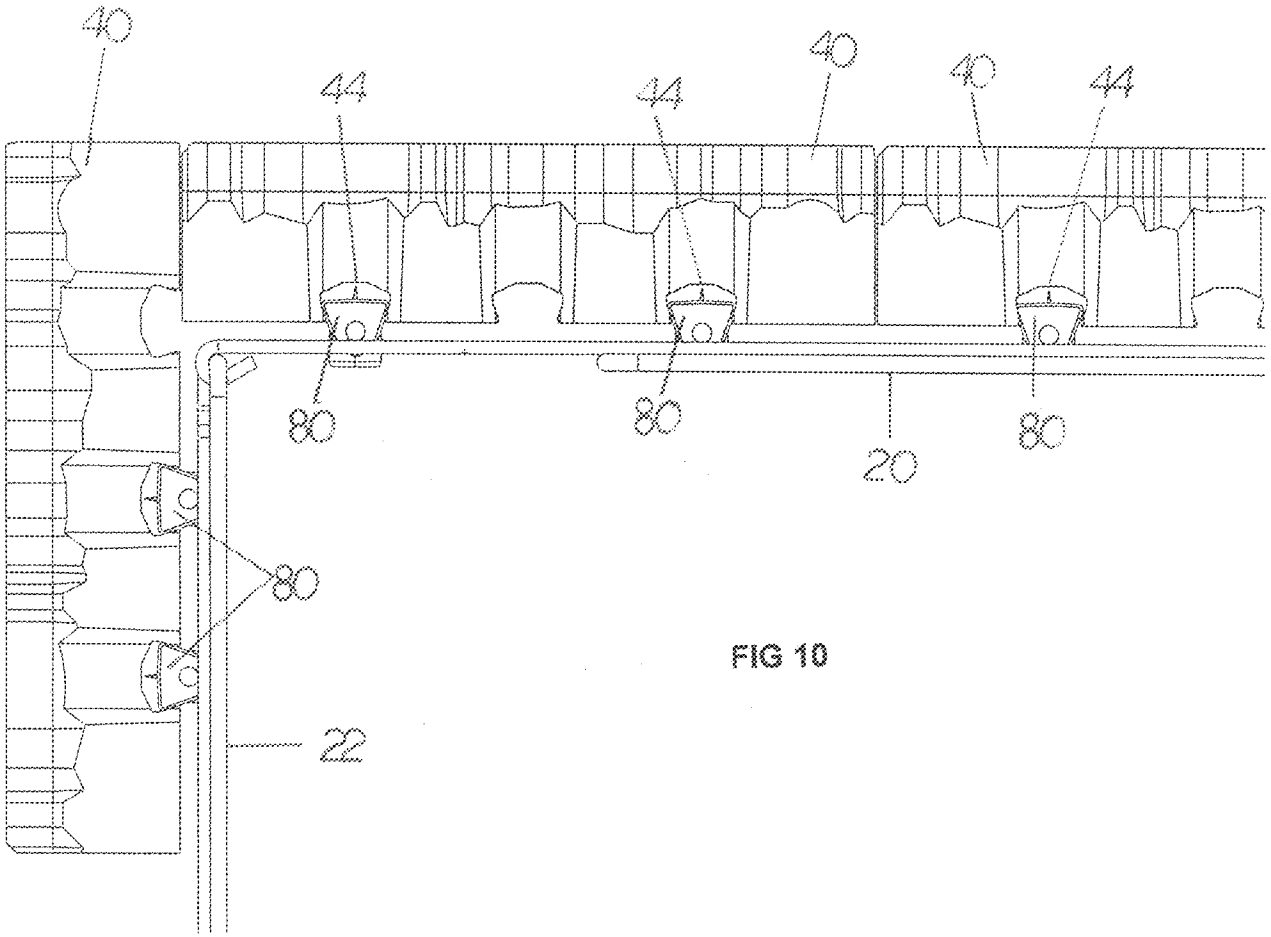
FIG. 10 is a top plan view of the assembly of FIG. 9.

During installation of the wall assembly, as illustrated in FIGS. 6 and 7, facing blocks 40 are mounted to the trellis panel 20 by placing the facing block 40 against a mounting member 23 and inserting a connector into the retaining groove 44 until the attachment portion 84 is fully engaged with the mounting member 23. If the attachment portion 84 is constructed to be slidable along the mounting member 23, when installed thereon, the horizontal position of the facing block 40 can be easily adjusted to ensure close lateral placement of the facing blocks in each row. Furthermore, vertical adjustment of the position of the facing block 40 relative to the trellis panel 20 is possible when the retaining portion 82 of the connector 80 slidably engages the retaining groove 44.

Installation of the wall assembly illustrated in FIGS. 16A-16E, wherein the mounting members 23 are shaped as mounting rails for engaging the retaining groove 44, includes the steps of engaging at least one retaining groove 44 in each facing block 40 with the top end of a mounting rail and moving the facing block 40 along the mounting rail until the block comes to rest on a base for the wall or an already previously installed block or blocks.

Figure 11:
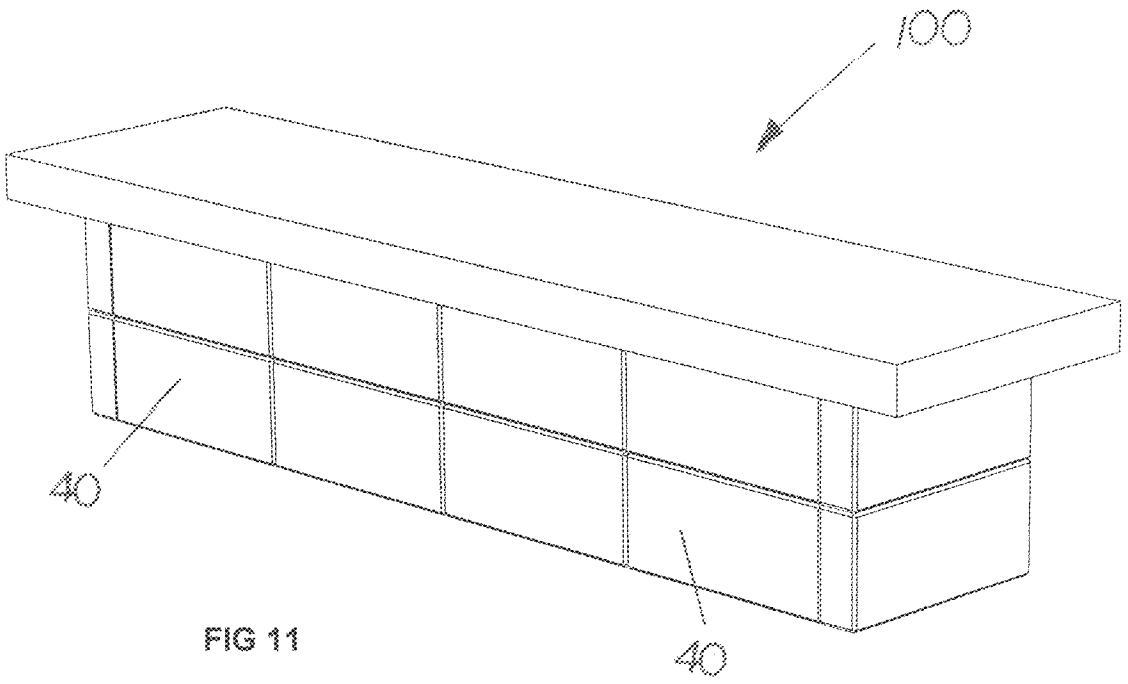
FIG. 11 is a perspective view of an illustrative assembly in accordance with the disclosure forming a bench.
Figure 12:
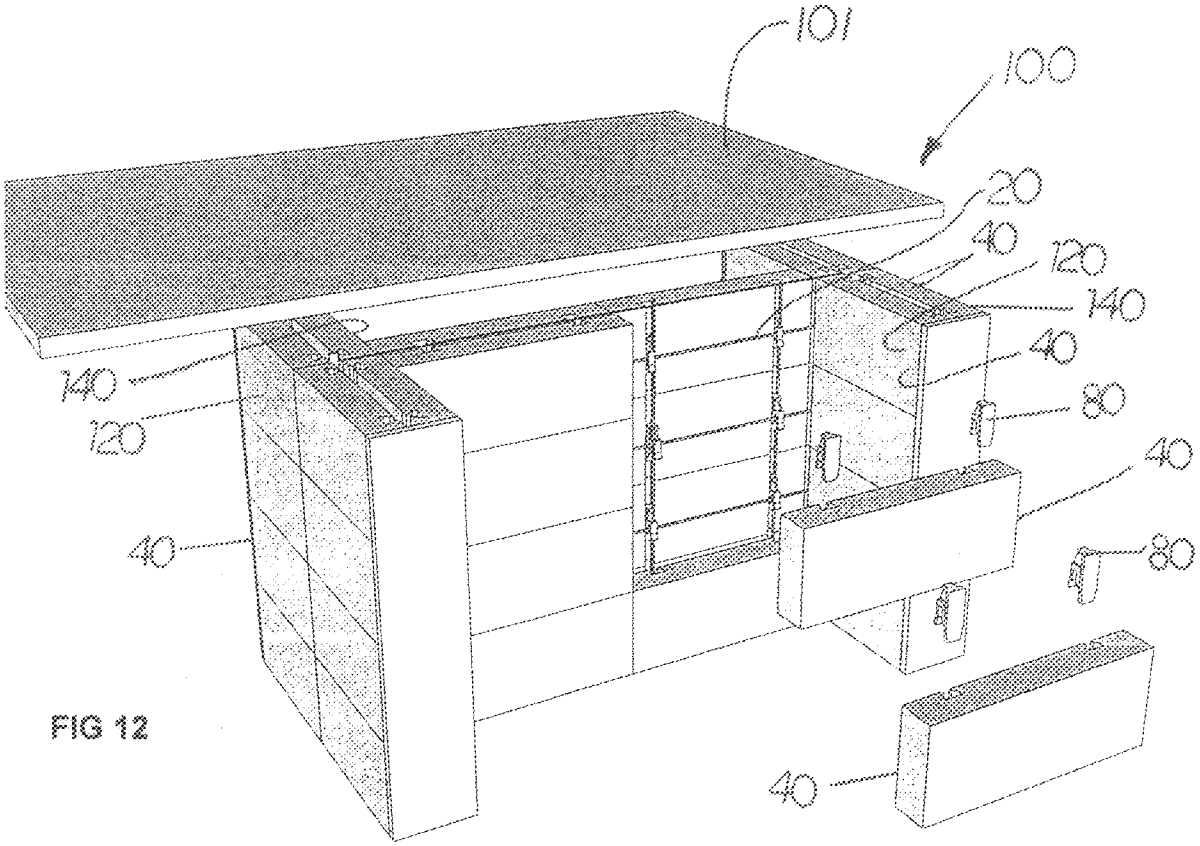
FIG. 12 is a partially exploded elevational view of another illustrative assembly forming a table.
Figure 14:
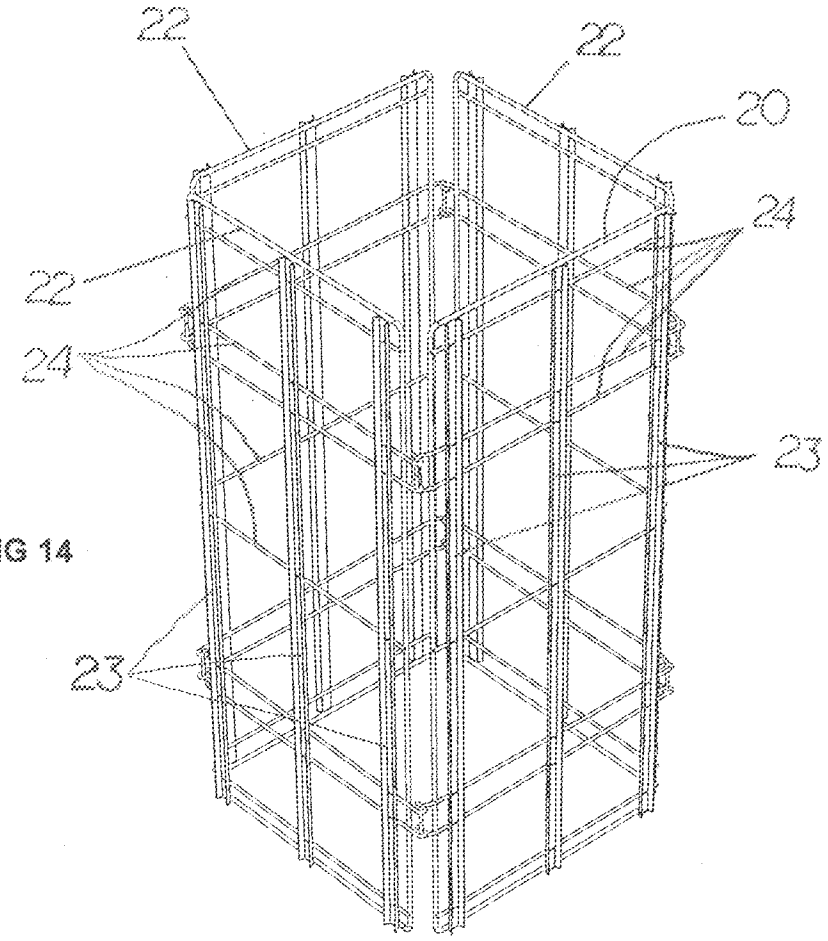
FIG. 14 is a perspective view of a combination of four interconnected trellis panels with incorporated connectors.
Figure 15:
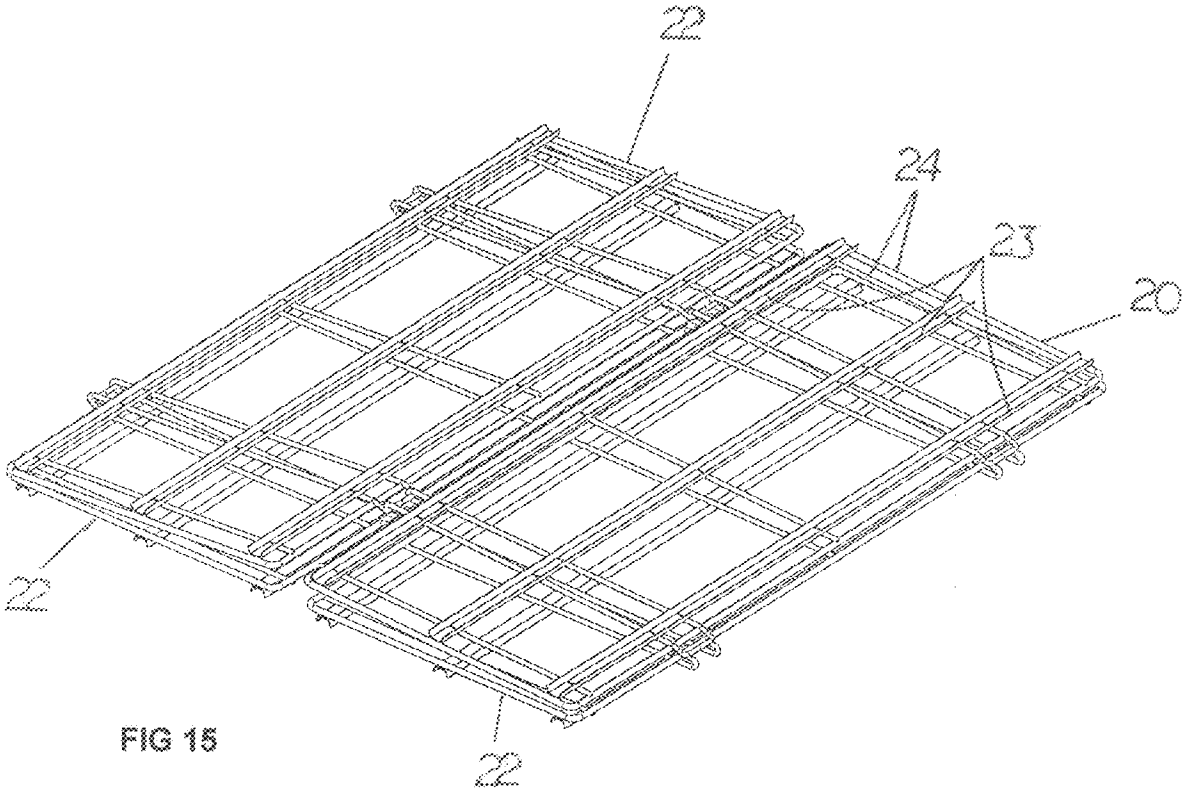
FIG. 15 is perspective view of the trellis panel combination of FIG. 14 in a folded condition.
Figure 16A:
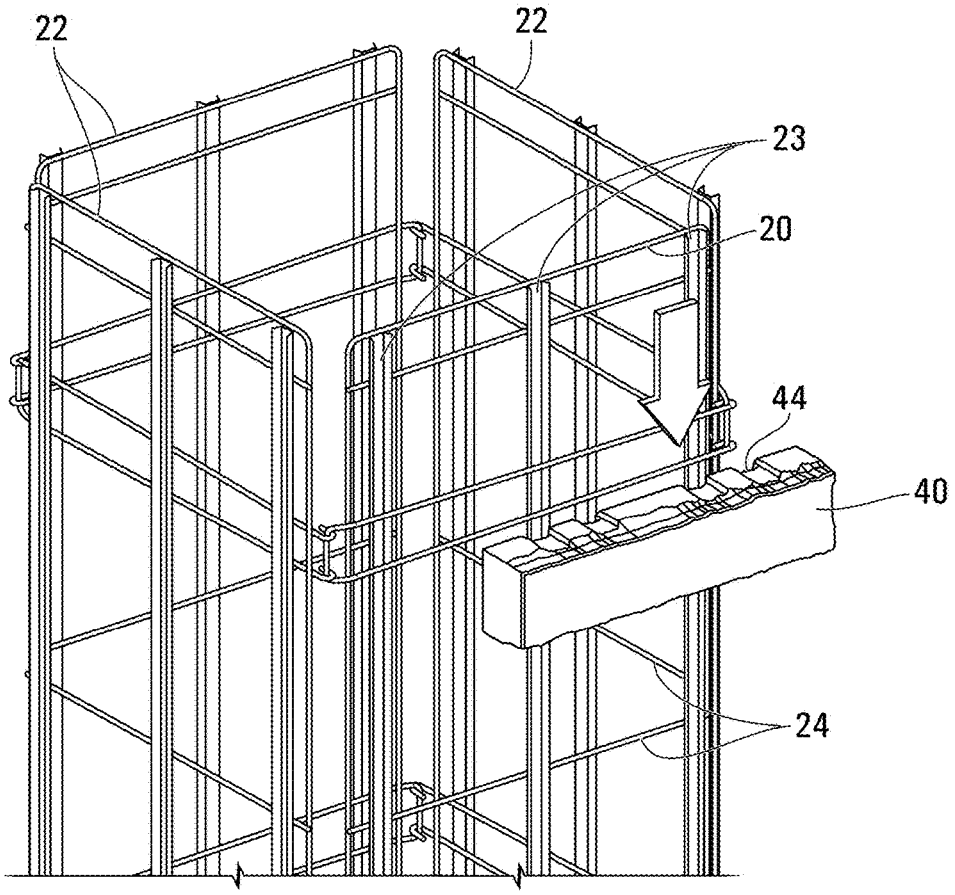
FIGS. 16A to 16E illustrate the installation of facing blocks onto the incorporated connectors of the trellis combination of FIG. 14.
Figure 16B:
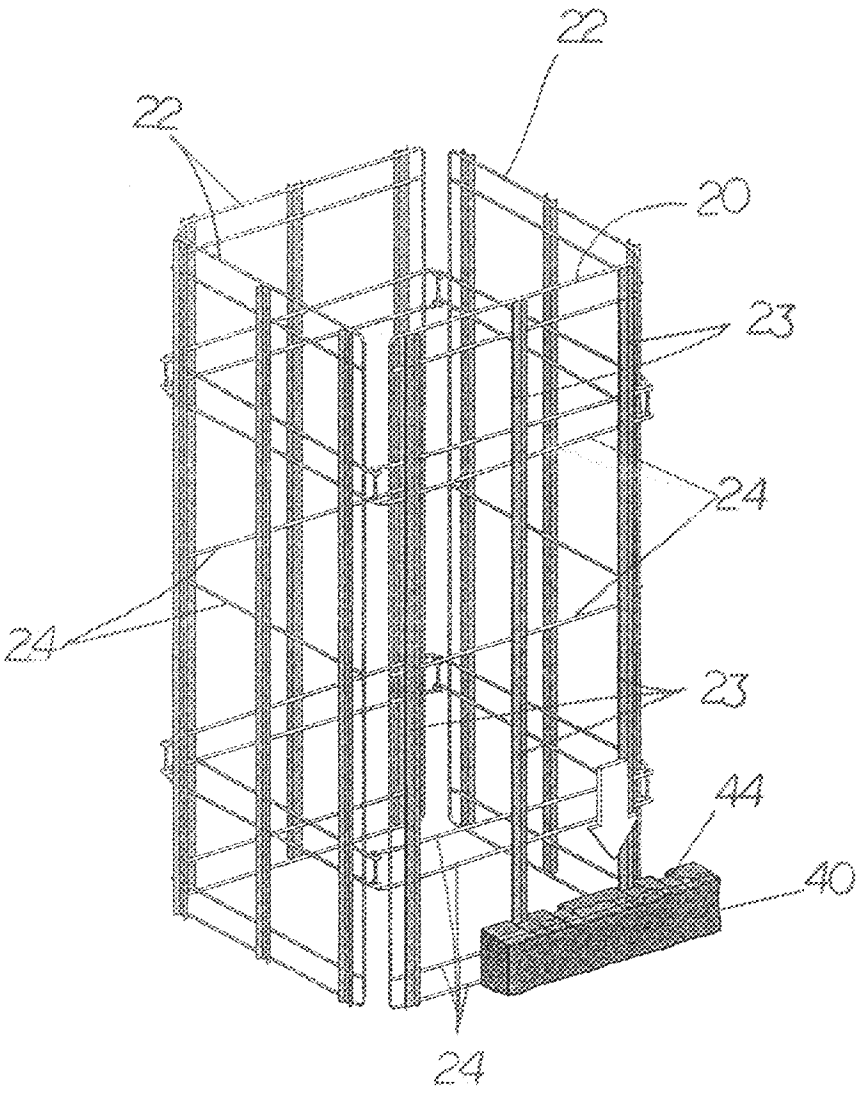
Figure 16C:
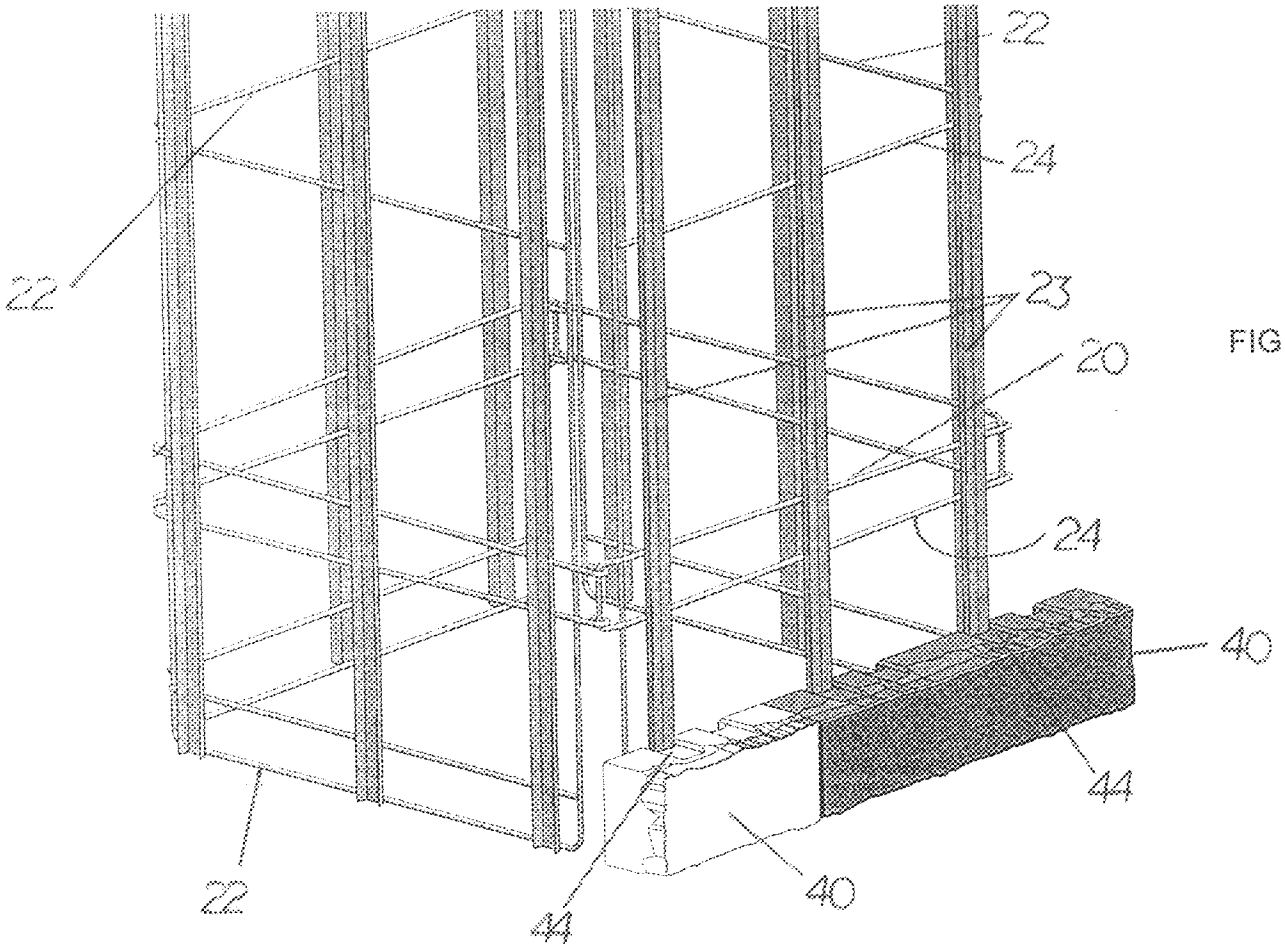
Figure 16D:
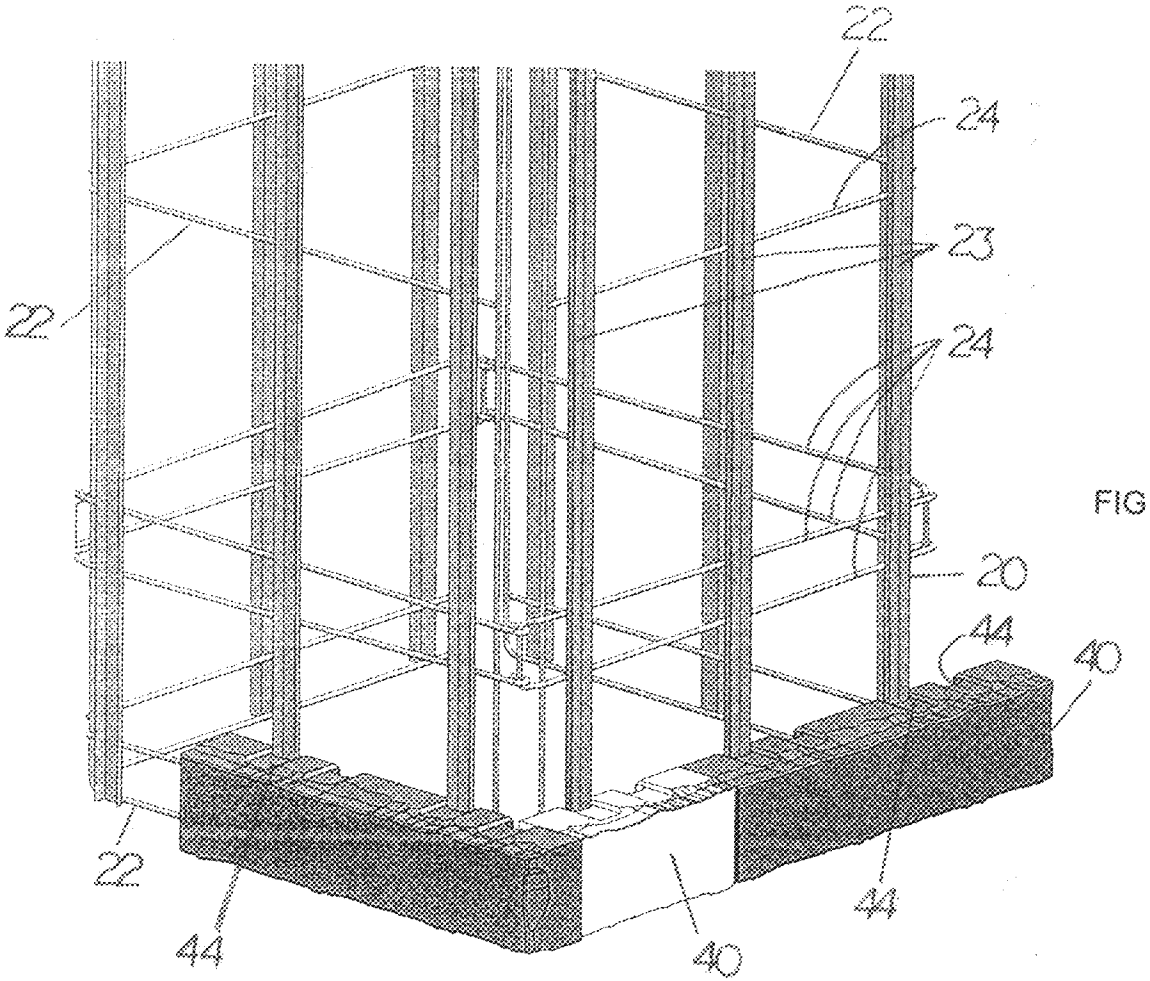
Figure 16E:
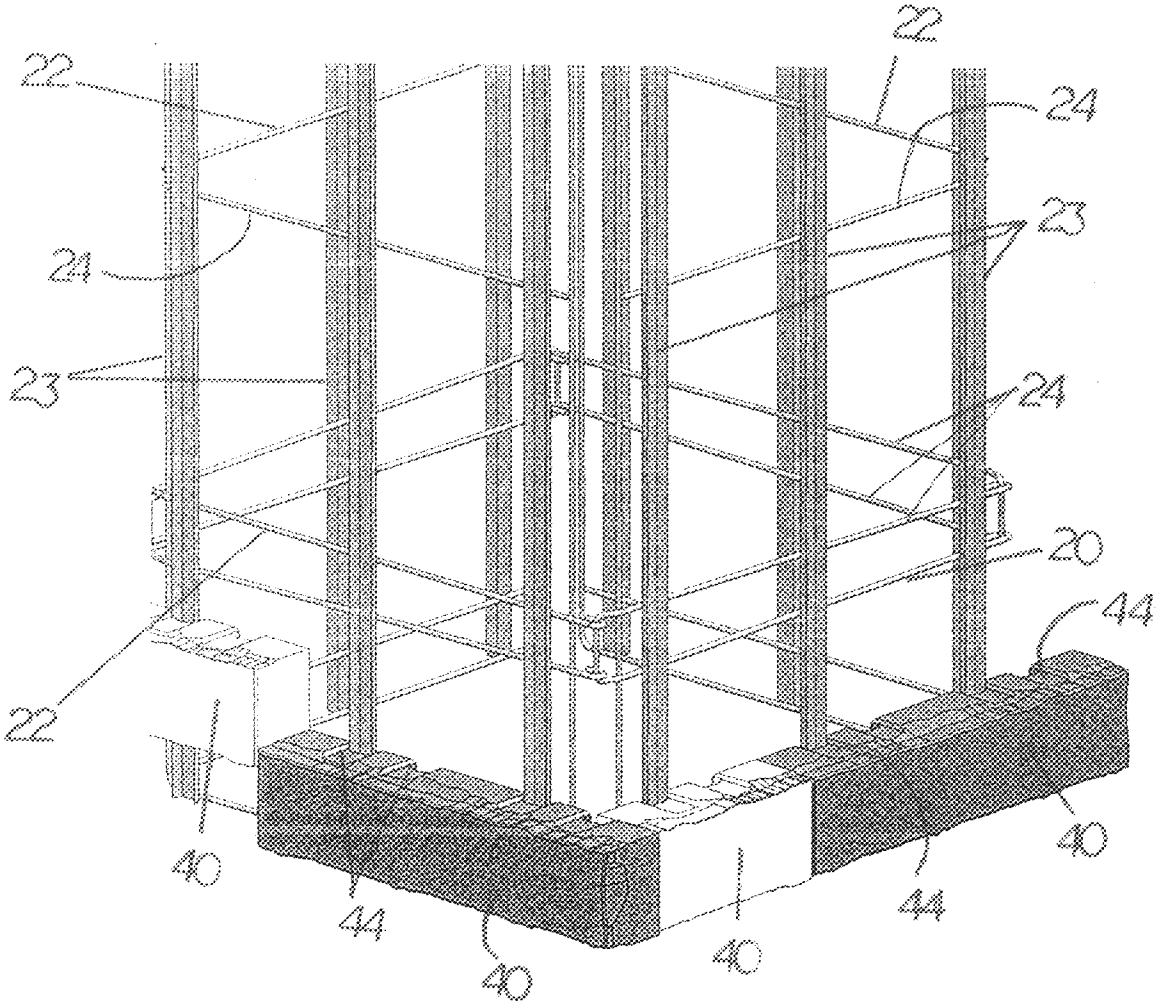
Figure 17:
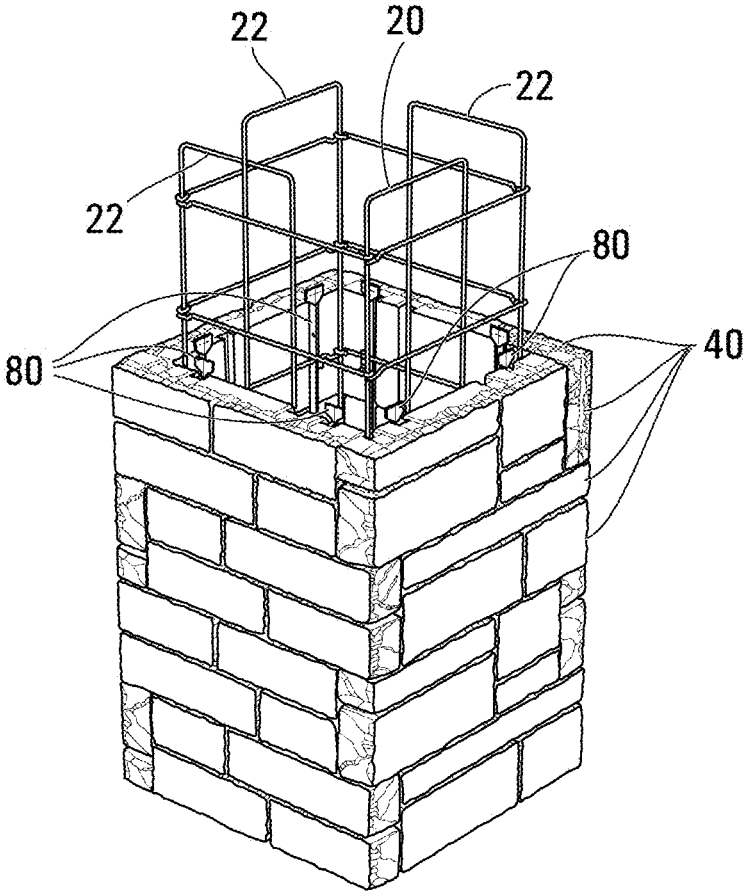
FIG. 17 is a perspective view of a partially finished masonry column including the trellis and block combination of the present disclosure and an aggregate fill.

In another basic embodiment of this disclosure as illustrated in FIGS. 9, 10, 11, 12 and 14-16E, at least one additional trellis panel 22 is connected end-to-end and at an angle with the trellis panel 20. By connecting multiple trellis panels, geometric shapes, such as L-shaped, U-shaped, T-shaped, H-shaped, Z-shaped structures, or polygonal structures may be built. In the latter case, at least two additional trellis panels 22 are respectively connected with opposite ends of the trellis panel 20. The trellis panel 20 and the additional trellis panels 22 together form an upstanding polygonal structure. In the embodiment illustrated in FIGS. 9, 10, 11 and 12, the trellis panel 20 and additional panels 22 form L-shaped, T-shaped or H-shaped structures. In FIG. 11, the wall assembly 100 is provided with a top cover in the form of a wood board to form a bench. In FIG. 12, an H-shaped arrangement of three trellis panels, the trellis panel 20 and two additional trellis panels 22 (not visible) is shown. Facing blocks 40 are attached to both sides of all three trellis panels 20, 22 by connectors 80 (not visible), resulting in an H-shaped structure that in the illustrated embodiment functions as the legs for a table top 101. In FIG. 14, an arrangement of four trellis panels, the trellis panel 20 and three additional trellis panels 22 is shown, wherein the trellis panels 20 and additional trellis panels 22 are connected to form a square column. A column finished with a masonry finish on all sides can be constructed by mounting the facing blocks 40 onto the mounting members 23, as shown in FIGS. 16A-16E, to the column of trellis panel 20 and additional trellis panels 22 as shown in FIG. 14.

In the embodiment of the column illustrated in FIGS. 14-16E, the column may be filled with a loose filler material (not shown) to form a pillar and capped with a cap stone (not shown), or capped without fill. In an alternative embodiment, facing blocks 40 may also be attached to the inside of the column to form a finished container or box.

Figure 2:
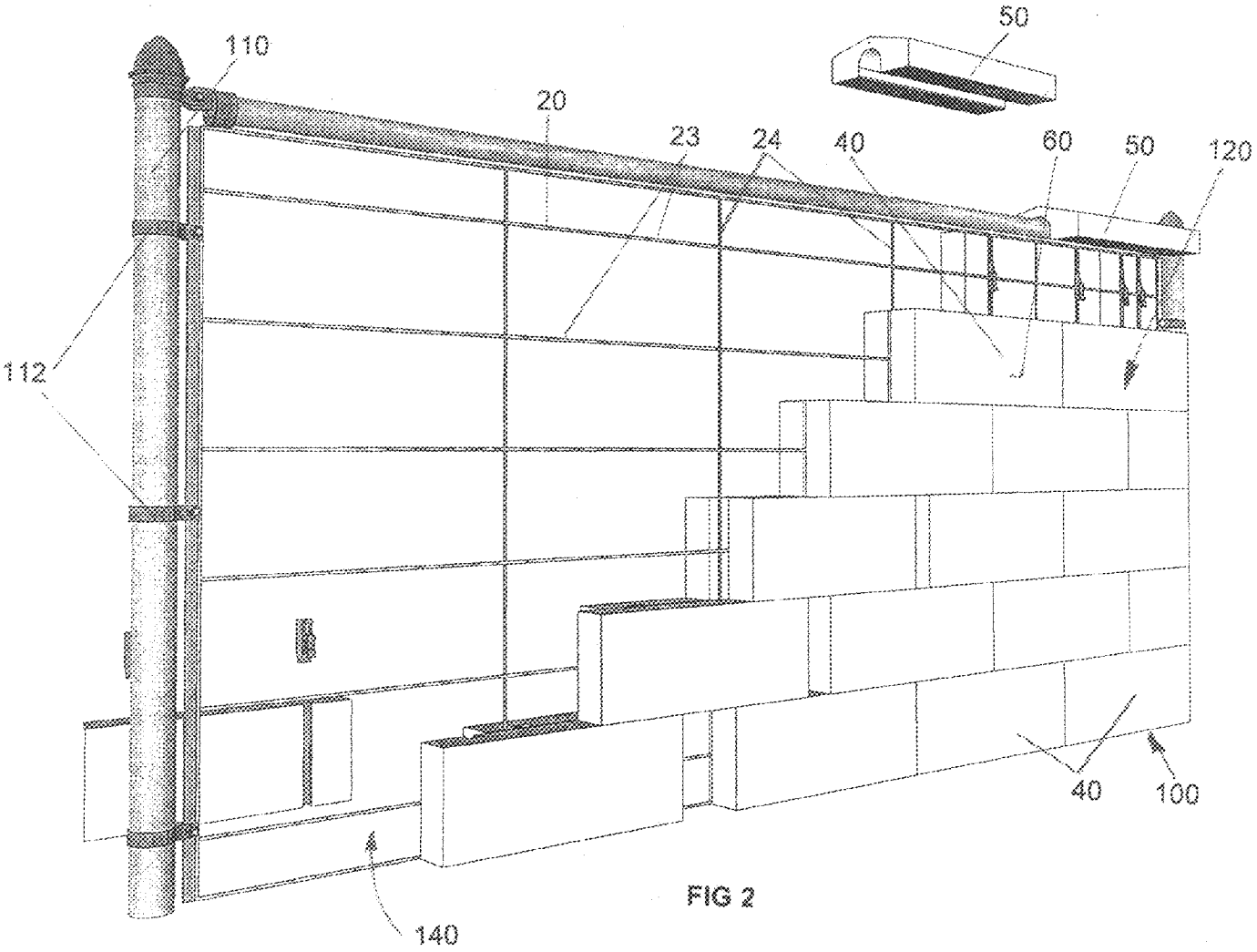
FIG. 2 is a detail elevational view of the exemplary wall assembly of FIG. 1 in partially assembled condition.

The facing blocks 40 may also be stacked on both sides of the trellis panel 20 to provide a double sided wall, for example the wall assembly illustrated in FIGS. 1 and 2. A cap stone 50 can be provided for capping off the double sided trellis wall assembly 100 and to reduce water infiltration into the wall from the top.

Although not all facing blocks 40 in the wall assembly 100 need be connected to the trellis panel 20, it is preferred that every facing block 40 be connected by at least one connector 80 to at least one mounting member 23. Preferably, each facing block 40 is preferably connected at a pair of spaced apart locations by a pair of connectors 80 to the trellis panel 20 for reliably holding all facing blocks 40 of the wall assembly in place in the stacked condition. If only every second facing block 40 is connected with the trellis panel 20, the remaining, unconnected blocks are preferably interlocked with the connected facing blocks, for example by interconnecting splines inserted into the retaining grooves 44. Alternatively, the retaining portion 82 of connectors 80 may be sufficiently long to engage the retaining grooves 44 of two or more stacked facing blocks 40, for added rigidity of the wall assembly. Moreover, for added design flexibility, connectors 80 can be used which include retaining and attachment portions (82, 84) which are oriented at a right angle to one another in order to permit installation of facing blocks in a 90 degree rotated orientation. In yet another alternative embodiment, the retaining and attachment portions 82, 84 of the connectors 80 may be rotatable relative to one another, as illustrated in FIGS. 21A to 21C, in order to permit use of the connector for the mounting of facing blocks in the basic orientation or any rotated orientation.

Figures 21A, 21B, 21C:
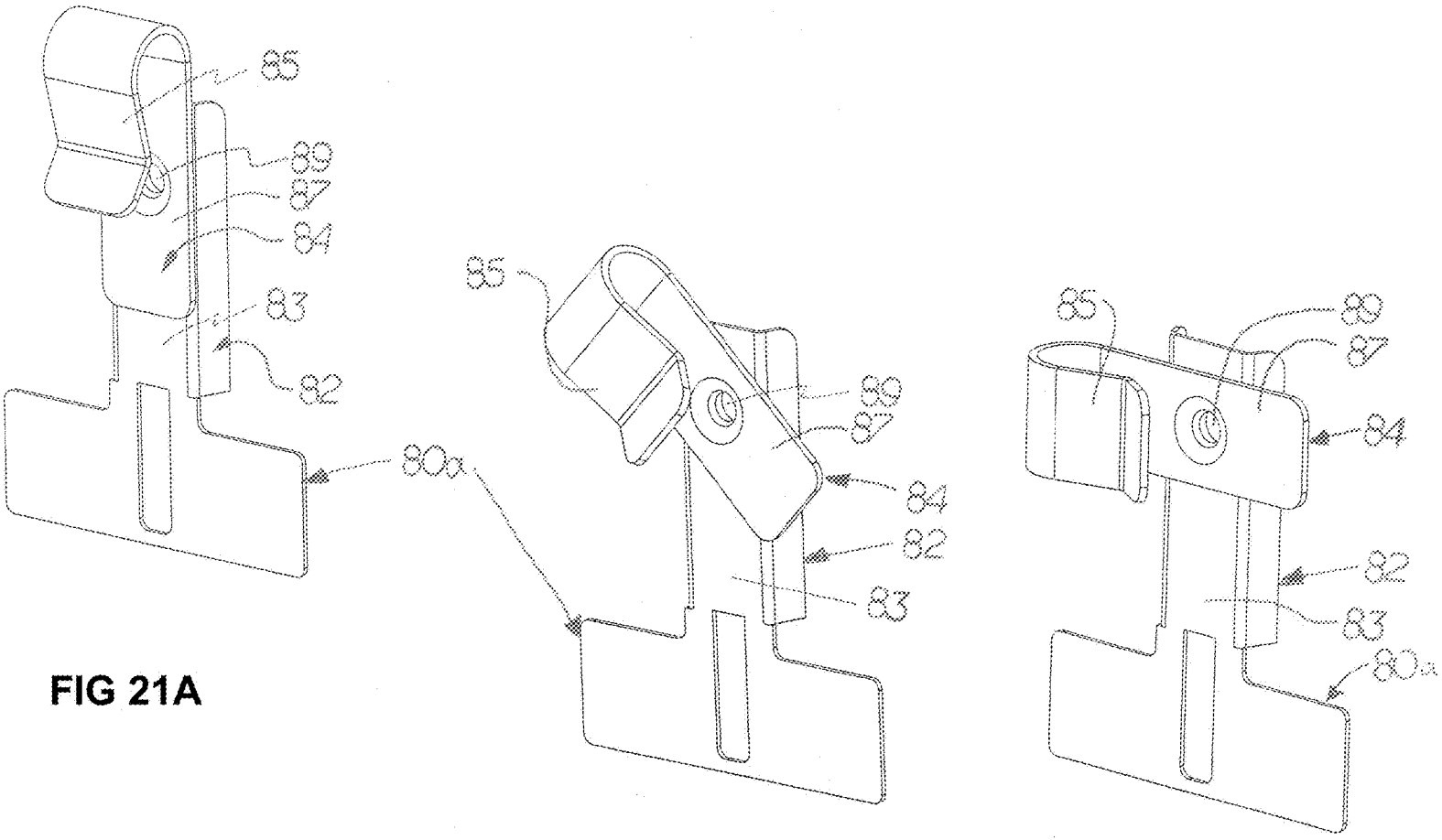
FIGS. 21A to 21C illustrate a connector with a rotatable hook portion.

The variant connector 80*a* of FIGS. 21A-21C includes the retaining portion 82 for engagement of the retaining groove of a facing block 40 and an attachment portion 84 divided into a fixed section 83 integral with the retaining portion 82 and a rotatable section 87, including the snap-on hook 85. The rotatable section 87 is connected with the fixed section 83 by a rotatable joint 89. The joint 89 preferably includes rotatably interengaged portions that can be integrally molded, stamped or manufactured with the fixed and rotatable sections apart and then snapped together during manufacture, or simultaneously stamped into the fixed and rotatable sections during manufacture. The connectors 80*a* are adjustable prior or during installation by the user to enclose different angles between the fixed and rotatable sections 83, 87. Different options for the design and manufacture of the rotatable joint 89 will be readily apparent to a person of skill in the manufacture of rotatable connections and need not be discussed in detail herein.

Connectors 80 may include a stabilizer tab 88 for engagement, when the connector 80 is installed in a facing block 40, with the rear surface of an adjacent block 40 (see FIGS. 18, 21*a*-21*c* and 43). The stabilizer tab 88 both aligns stacked blocks in successive rows and reduces a tendency of stacked blocks to slightly pivot around the mounting member 23 to which they are respectively connected by the connector 80.

Figure 43:
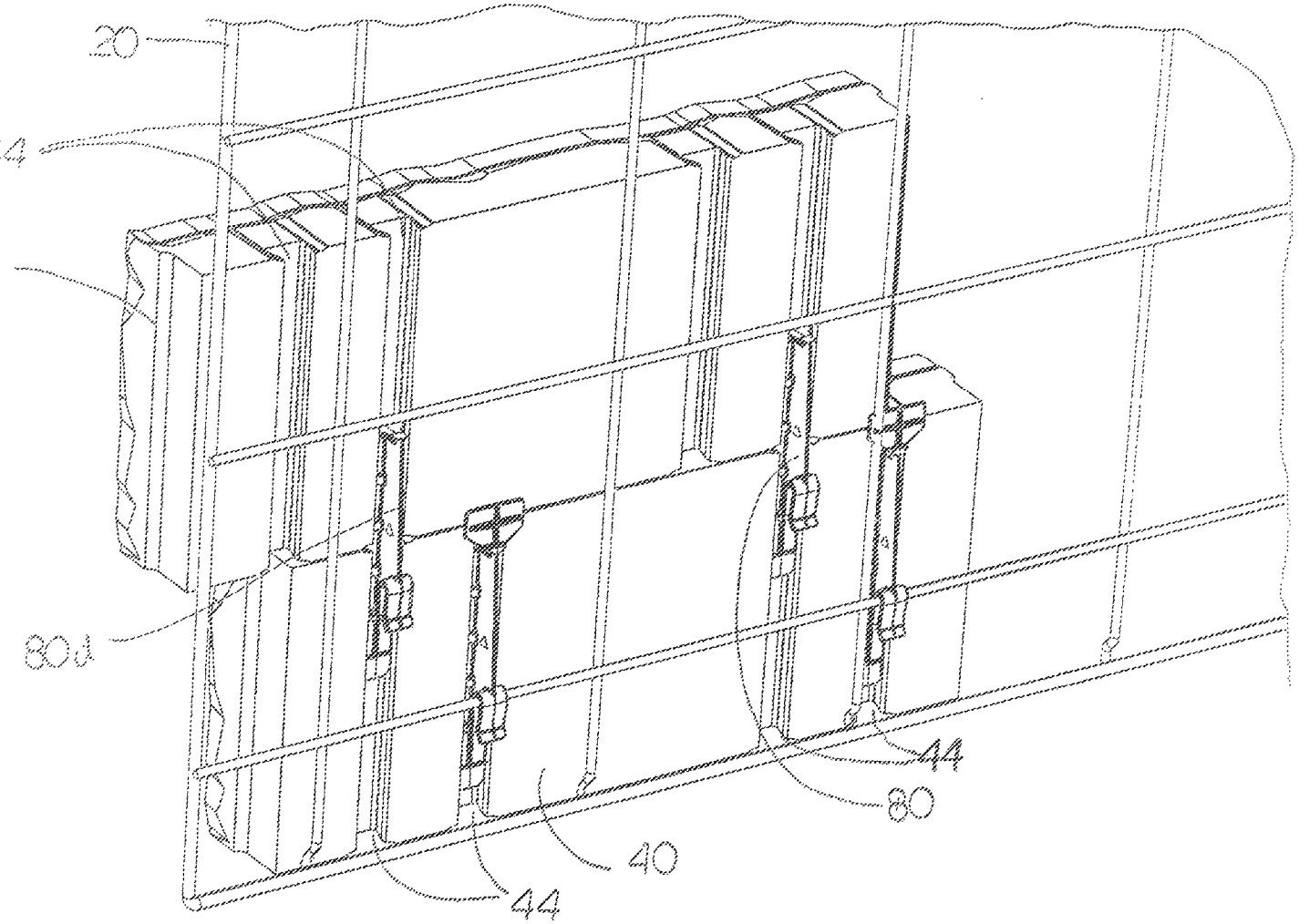
FIG. 43 illustrates a pair of adjacent facing blocks connected together by bridging connectors.

In the preferred embodiment, a rear surface 42 of each facing block 40 is connected to the trellis panel 20 by a pair of spaced apart connectors 80, each slidably received in a retaining groove 44. Each connector 80 is movably connected to one of the trellis panel and the facing block to allow shifting of the blocks within the wall without buckling or leaning of the wall assembly. To provide the wall assembly with further improved stability, rigidity and buckling resistance, a bridging connector 80*d* as shown in FIG. 43 can be used. The bridging connector 80*d* is inserted into one or more of the retaining grooves 44 of a pair of vertically, horizontally or otherwise adjacent facing blocks 40. This provides additional stability. Preferably, multiple pairs of facing blocks 40 are connected in this manner in the wall assembly of the present application. More preferably, every second pair of facing blocks 40 is bridged in this manner. For maximum stability, each pair of blocks in the wall assembly includes at least one bridging connector 80*d*.

As shown in FIGS. 2-4 and 12, the first and second facing walls 120, 140, respectively assembled from facing blocks 40, are closely spaced in a back to back orientation and are spaced solely by the thickness of the trellis panel 20. However, in a variant of this double sided wall assembly in accordance with the present disclosure (not illustrated), the first and second facing walls are spaced apart at a selected distance by extended connectors 80*b* (see FIGS. 19-20) having an extended body or spline 89 between the attachment and retaining portions 84, 82. This results in a hollow wall, where a hollow space is formed within the double sided wall with the trellis panel 20 positioned in the center of the hollow space and the facing blocks 40 spaced from the trellis panel 20 on each side by way of the extended connectors 80*b*. This hollow space can then be filled with a loose filler material to form a wall of added mass and rigidity. In one alternative, the wall is filled with soil to allow greening of the wall by growing a plant cover on the outside of the wall.

The first and second facing walls 120, 140 can be assembled from the same facing blocks 40 or from facing blocks of different appearance to provide the wall with a different appearance on opposite sides. Facing blocks 40 of varying appearance can also be used in the same face of the wall to simulate the appearance of a natural stone wall, or to provide design features or patterns.

Figure 13:
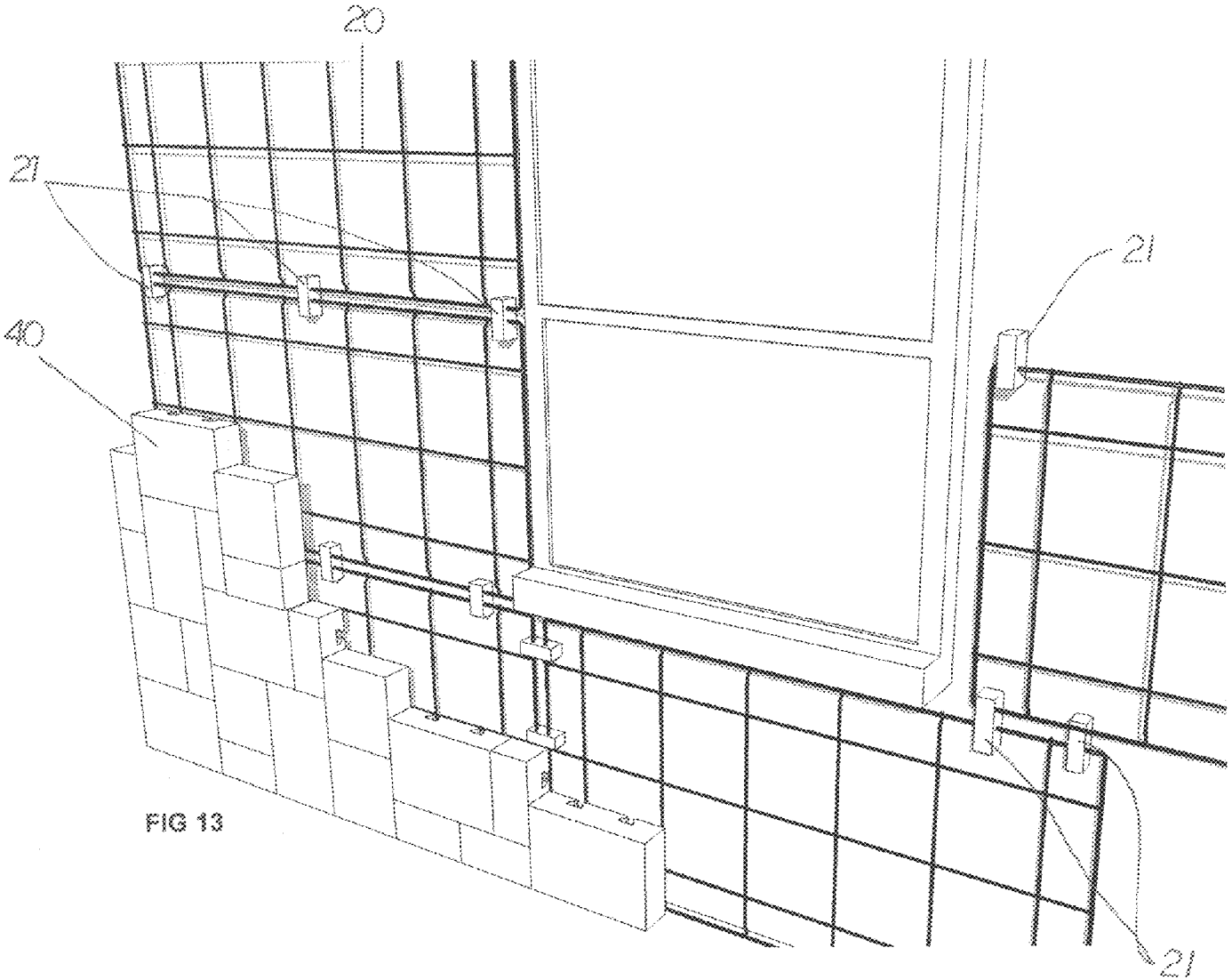
FIG. 13 is a perspective view of a further illustrative assembly in accordance with the present disclosure, forming a masonry building finish.

In a retrofit application, as illustrated in FIG. 13, the wall assembly of the present disclosure can be used to provide an existing wall, for example a building wall, with a masonry finish. In this retrofit application, the trellis panel 20 can be attached to the existing wall structure by fasteners 21. The facing blocks 40 are then stacked on a supporting ledge or base (not visible) and maintained against the wall structure by the connectors 80.

In another retrofit application, the facing blocks 40 and connectors 80 of the wall assembly may be used to provide a finish on existing structures including a rigid trellis or lattice structure to which the facing blocks can be connected directly. Examples of existing structures are wire baskets filled with loose rock and used for retaining wall or landscaping applications.

Figure 18:
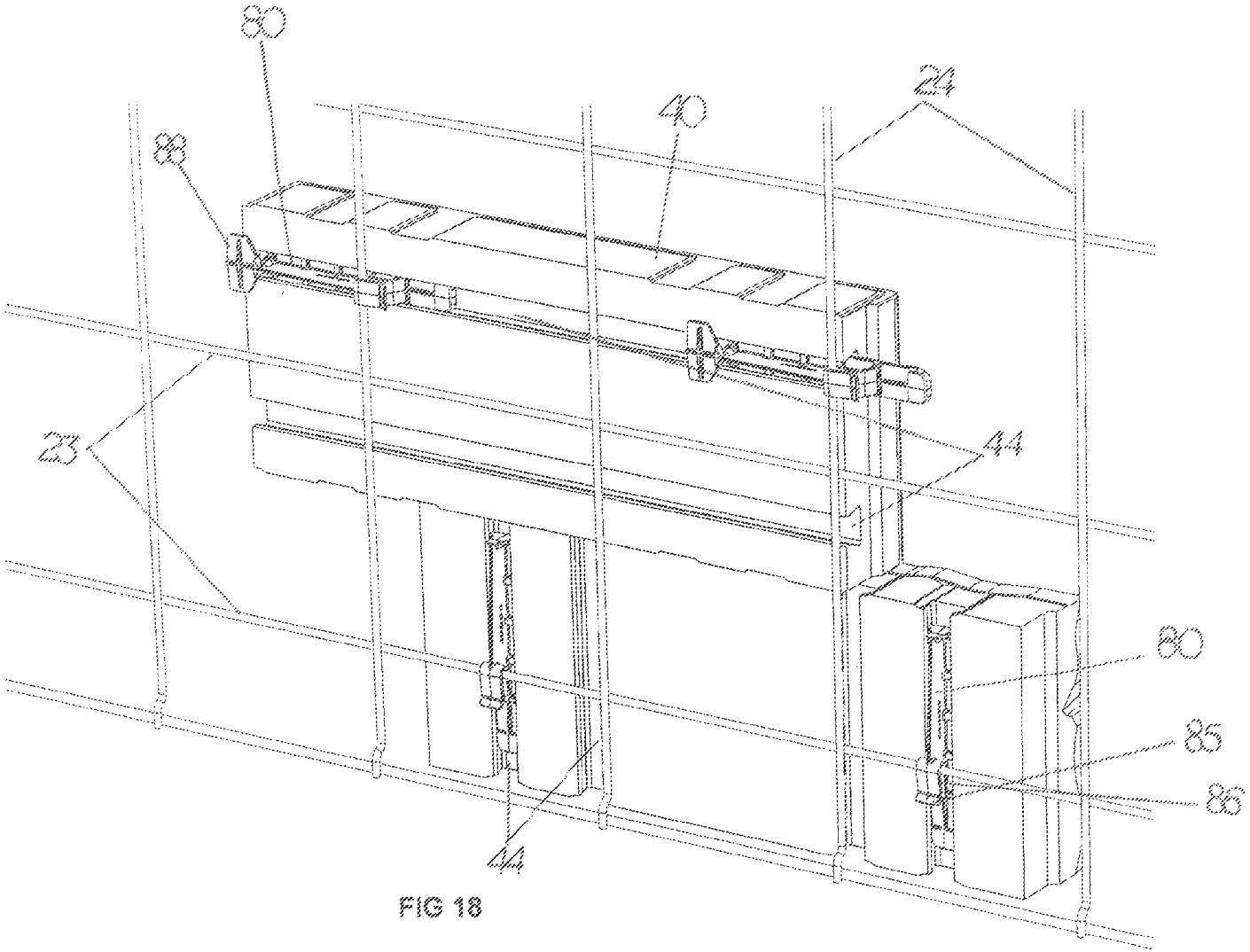
FIG. 18 illustrates a variant design of a facing block of the wall assembly of FIGS. 1 to 10.

In a variant design of the wall assembly as illustrated in FIG. 18, the facing blocks 40 are provided with retaining grooves 44 extending either vertically or horizontally when the blocks 40 are in the installed condition. This allows not only for the positioning of the blocks 40 in different orientations, but for a larger flexibility for designing and assembling the wall. When blocks 40 as illustrated in FIG. 18 are used, the connectors 80 are attached to either the mounting members 23 of the trellis panel 20 or the support members 24.

Figure 19:
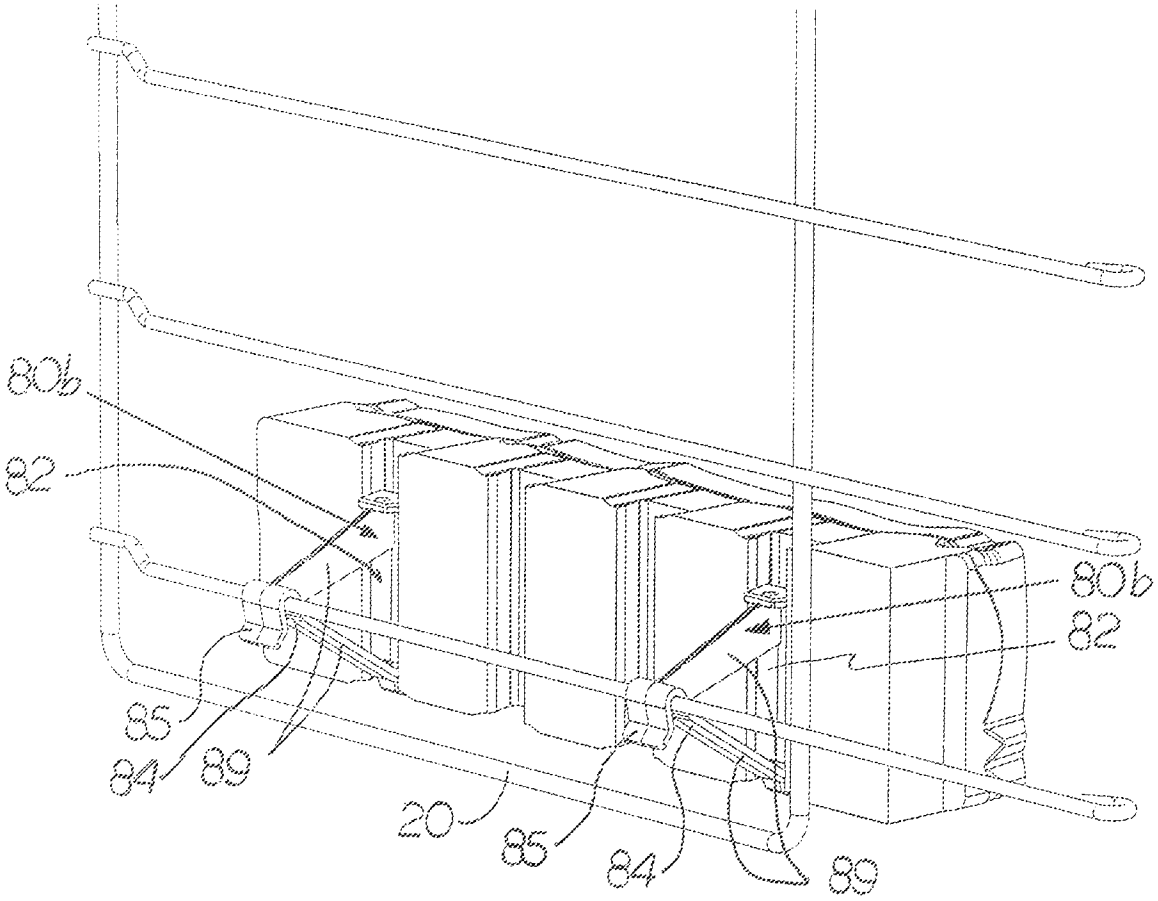
FIG. 19 is a perspective view of a wall assembly with a variant design of a connector used to create a spacing between the facing blocks and the trellis panel.
Figure 20:
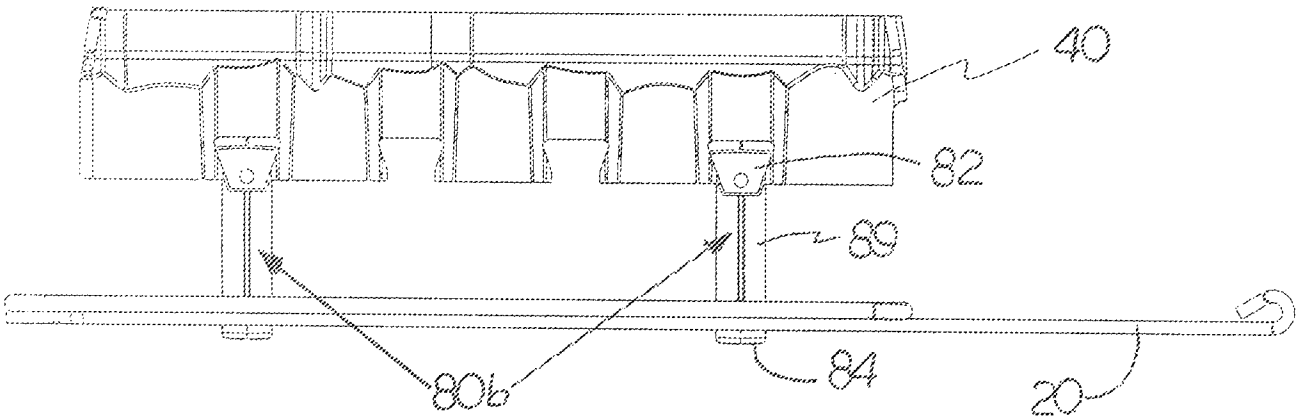
FIG. 20 is a top view of the wall assembly of FIG. 19.

In still a further variant design of the wall assembly of this disclosure (not illustrated), the wall assembly is used to provide a retaining wall and the trellis panel is combined with facing panels attached to the trellis panel and backer blocks embedded in the material to be retained and connected to the trellis panel by extended connectors 80*b* similar to those illustrated in FIGS. 19 and 20.

Figure 22:
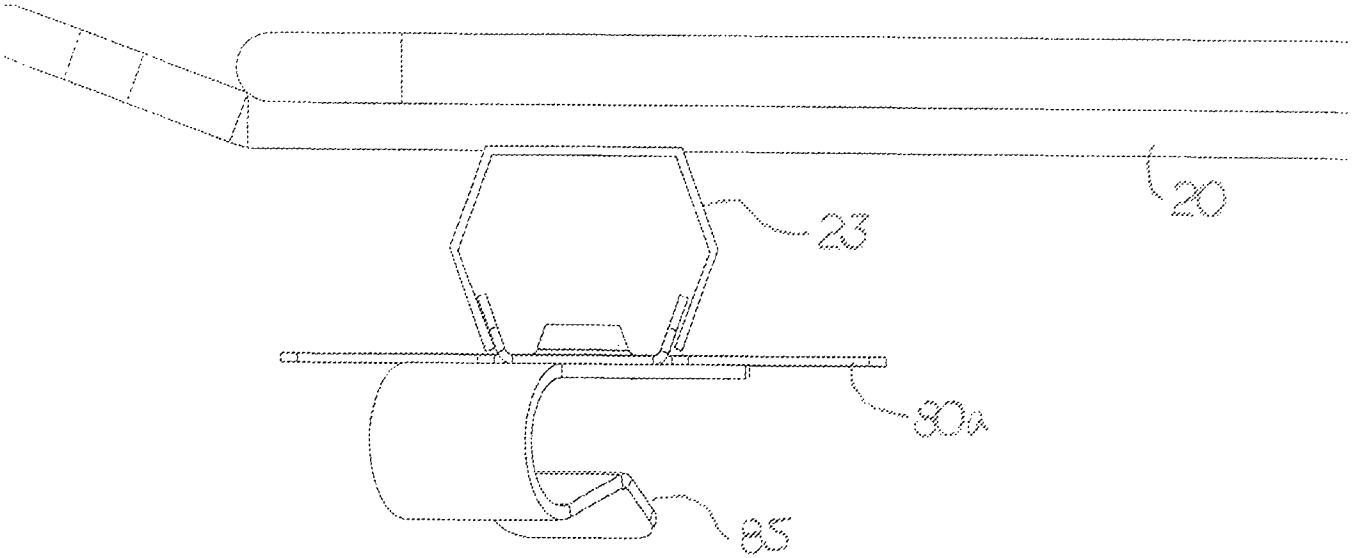
FIG. 22 is a partial top plan view of the trellis panel of FIGS. 16A-16E, showing the mounting member shaped as a mounting rail.
Figure 29:
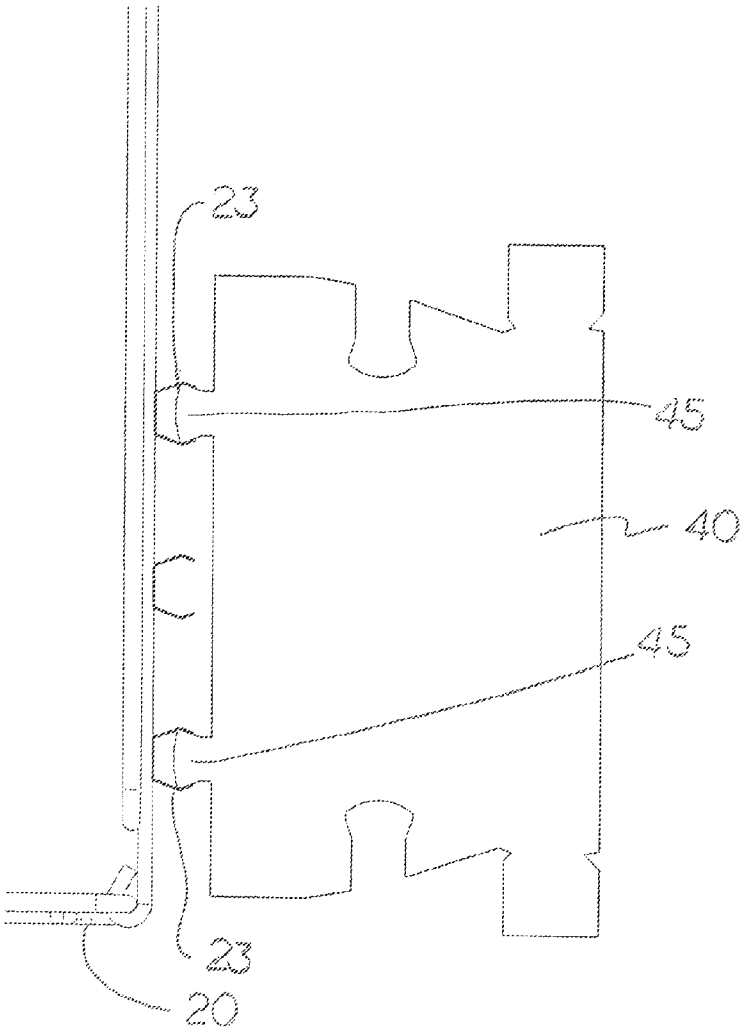
FIG. 29 is a partial top plan view of the trellis panels of FIGS. 16A-16E and similar to FIG. 22, but illustrating a structural block connected to the mounting rail.
Figure 30:
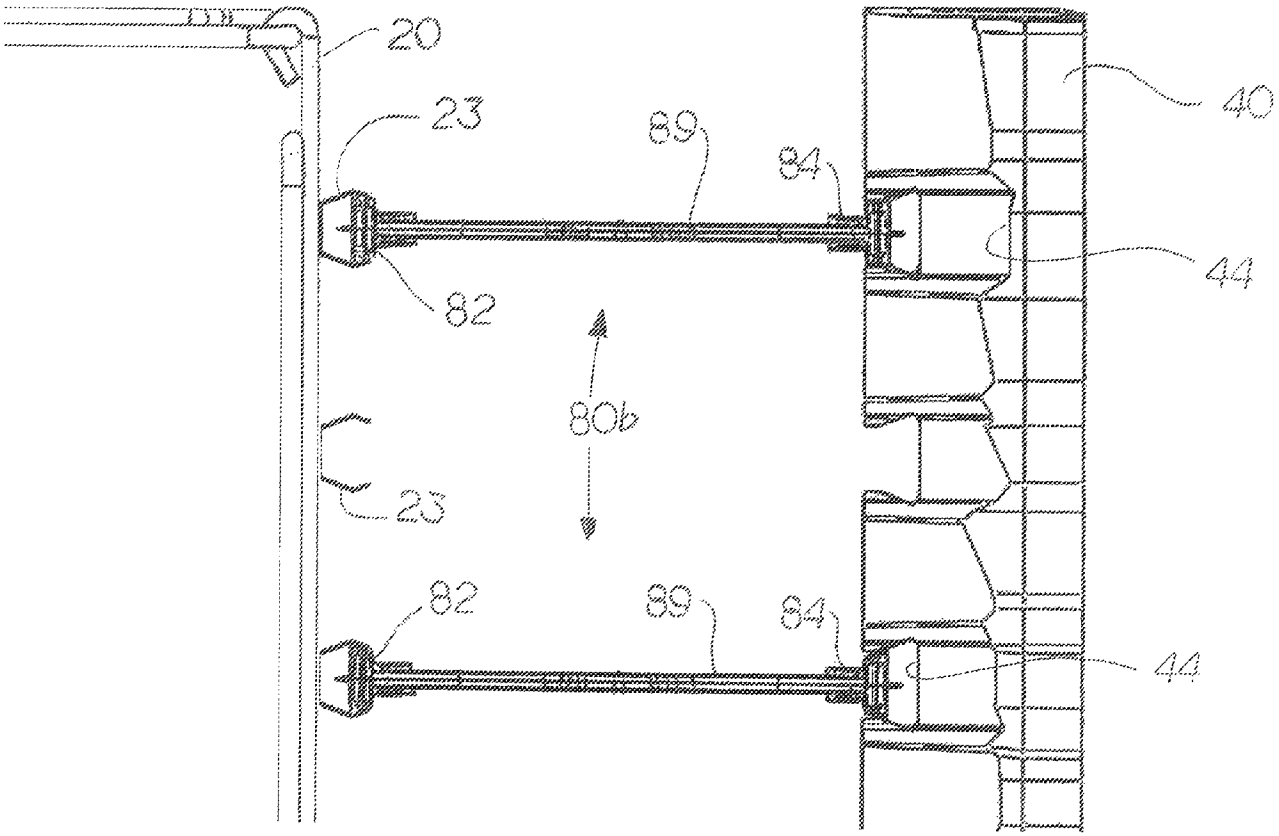
FIG. 30 is a partial top plan view of the trellis panels of FIGS. 16A-16E and similar to FIG. 22, but illustrating a connector/spacer connected to the mounting rail and a facing block.

As shown in FIG. 22, the mounting member 23 of trellis panel 20 can be shaped as a mounting rail. The mounting rail variant of the mounting member 23 is made from a rigid material and has an external shape for interlocking with the retaining groove 44 of a facing block 40 (see FIGS. 16A-16E), or retaining stubs 45 of a facing block 40 as shown in FIG. 29, and an internal shape for receiving and interlocking with a connector 80 (see FIG. 30), particularly the retaining portion 82 of an adjustable connector 80*a* as shown in FIG. 21A-21C. The connector 80 may also have an elongated body extending between the attachment and retaining portions (84, 82) of the connector, as illustrated in FIG. 30. This allows for the spacing of the facing blocks at a distance away from the trellis panel 20.

Figure 23A:
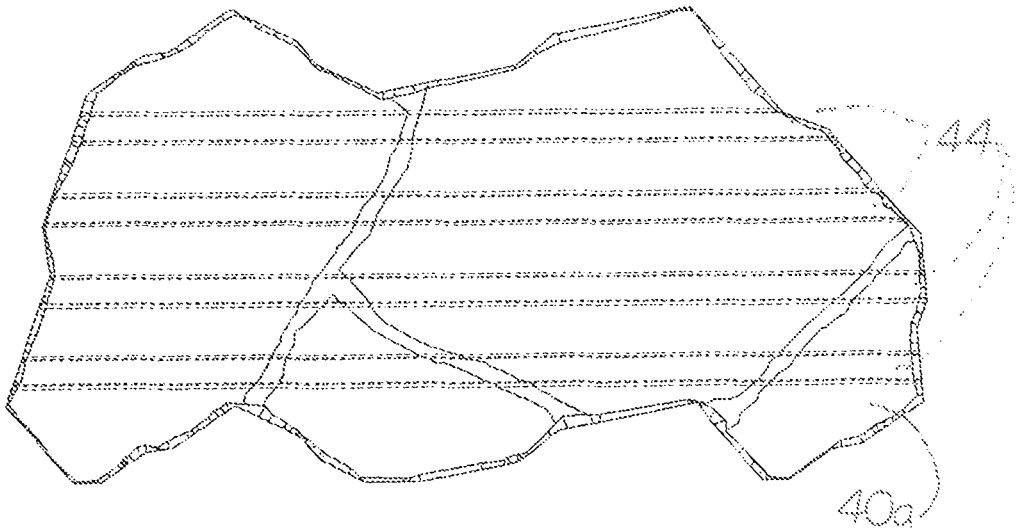
FIG. 23A illustrates a set of irregular facing blocks in top view with the retaining grooves shown in phantom lines.
Figure 23B:
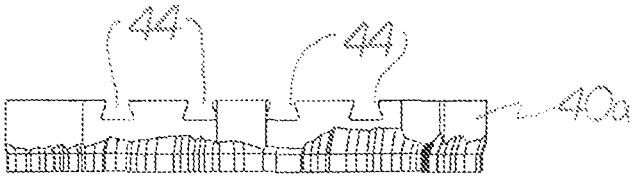
FIG. 23B is a side elevational view of one of the facing blocks of FIG. 23A.
Figure 24:
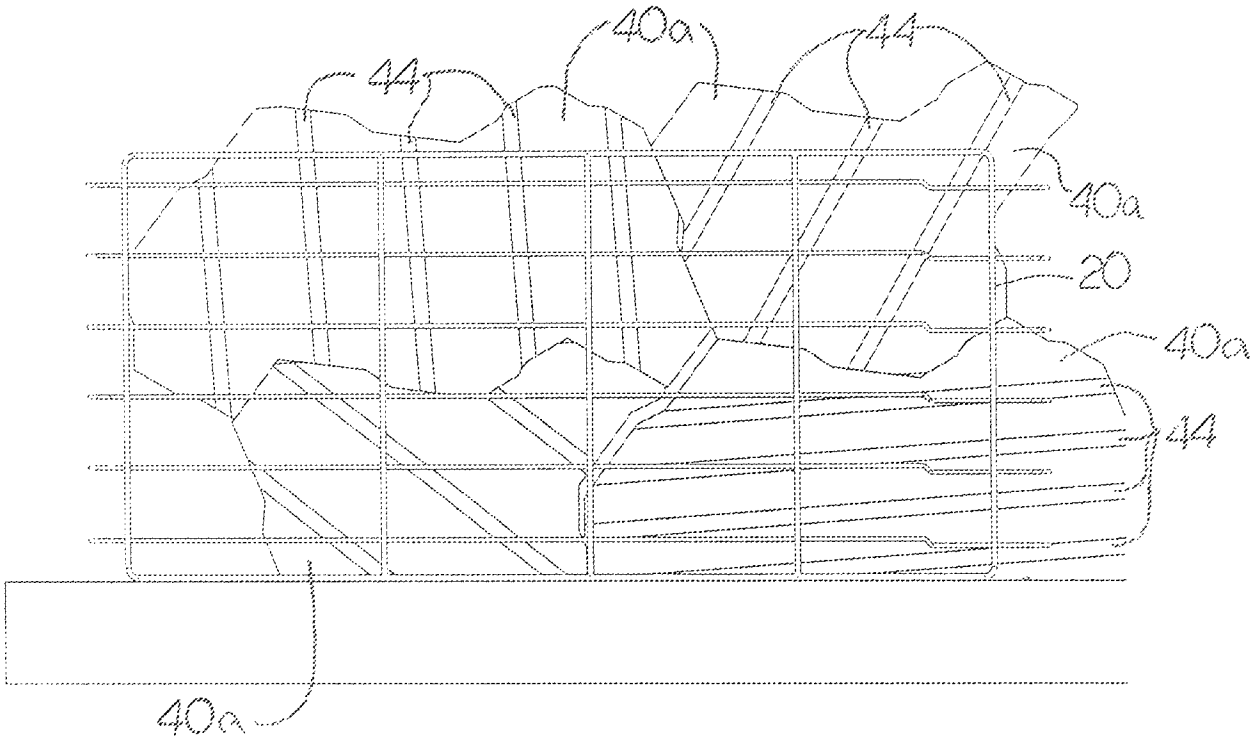
FIG. 24 is a rear plan view of a wall assembly including a trellis panel and the facing blocks of FIG. 23A, the connectors being omitted.
Figure 25:
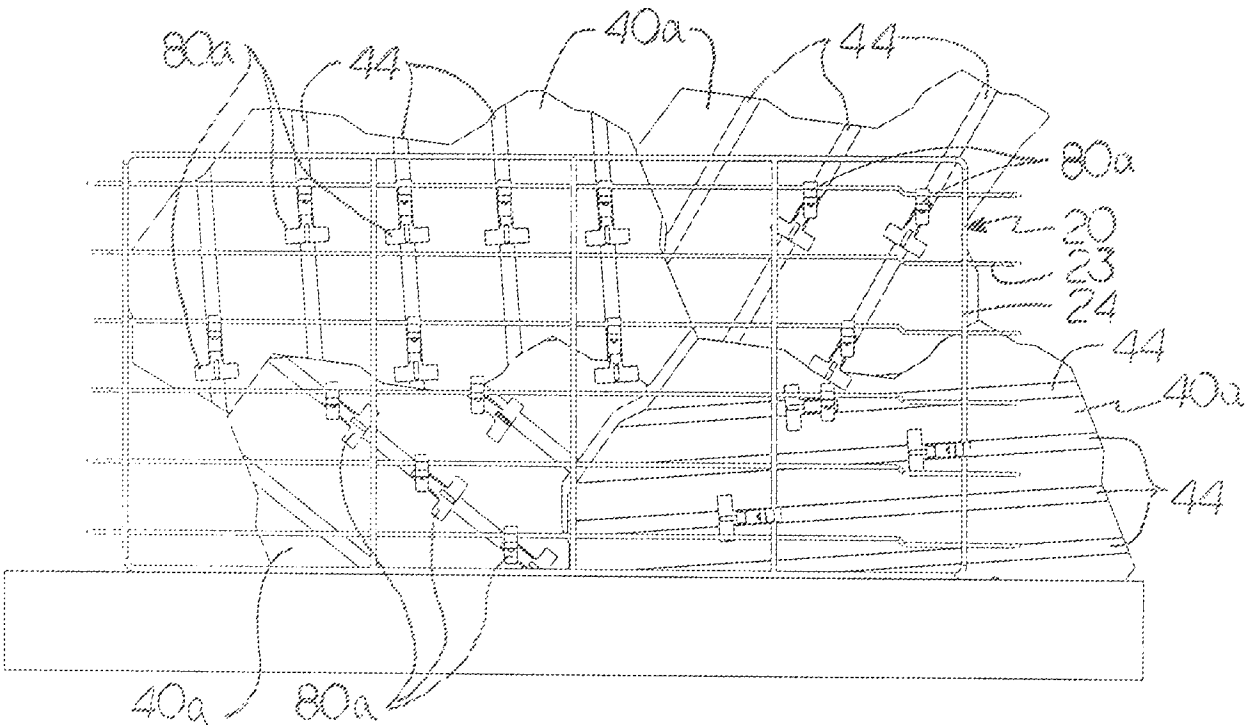
FIG. 25 is the rear plan view of the wall assembly illustrated in FIG. 24, further including the rotatable connectors.

As is apparent from FIGS. 23A and 23B, the wall assembly of the present invention can include facing blocks 40*a* which have an irregular shape and even may each have a different surface appearance. The facing blocks 40*a* of this variant of the wall assembly of the present disclosure have dovetail shaped retaining grooves 44 which extend at an angle other than perpendicular to an edge of the block. Moreover, when the irregularly shaped facing blocks 40*a* are stacked into a facing wall, as shown in FIG. 24, the retaining grooves 44 extend at different angles to one another and to the support and mounting members 24, 23 of trellis panel 20. This necessitates the use of adjustable connectors 80*a* for connection of the irregularly shaped facing blocks 40*a* to the trellis panel 20, as illustrated in FIG. 25.

Figure 26:
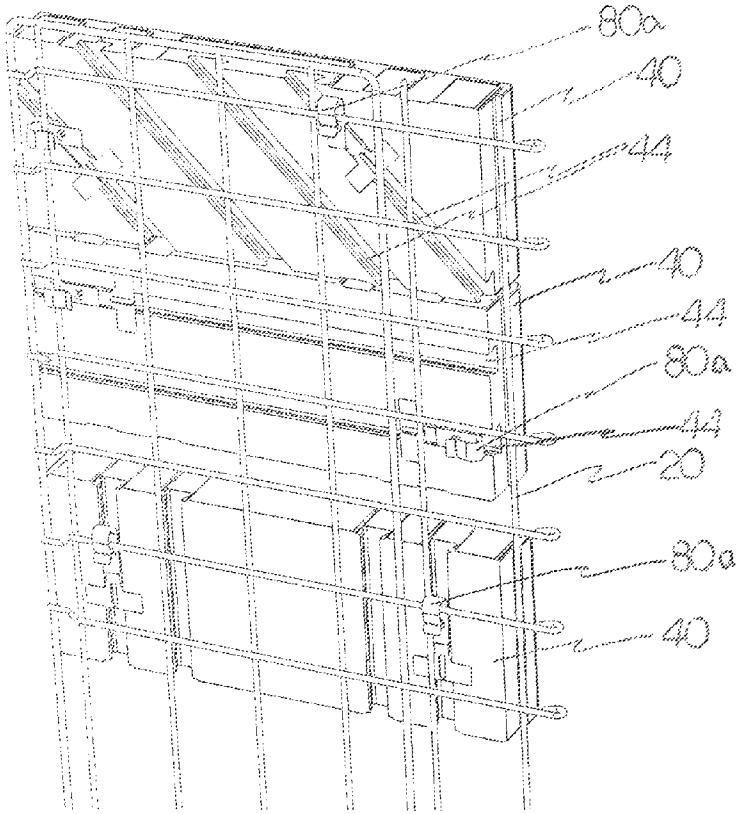
FIG. 26 is a schematic rear view of a wall assembly including facing blocks with retaining grooves of different orientation.

FIG. 26 shows regularly shaped facing blocks 40 with retaining grooves 44 oriented either perpendicularly to an edge of the block or at an angle, such as 45 degrees to an edge of the block. As is clearly apparent, the adjustable connectors 80*a* can be used to connect the facing blocks 40 to the trellis panel 20 regardless of the orientation of the retaining groove 44 and regardless whether the connector is hooked onto a supporting member 24 or a mounting member 23.

Figure 27:
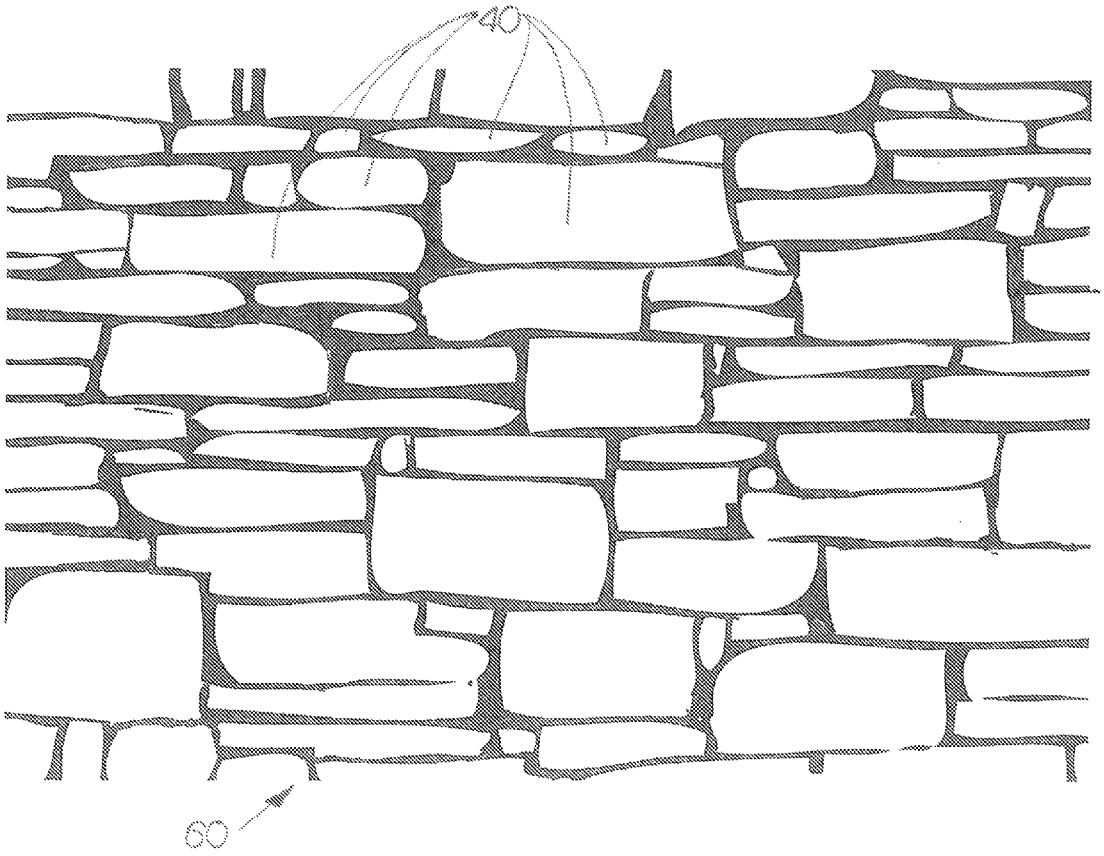
FIG. 27 is a front plan view of a wall assembly of this disclosure including facing blocks of different sizes.

FIG. 27 illustrates a wall assembly in accordance with the present disclosure wherein various facing blocks 40 of different size are stacked into the facing wall 60.

Figure 28:
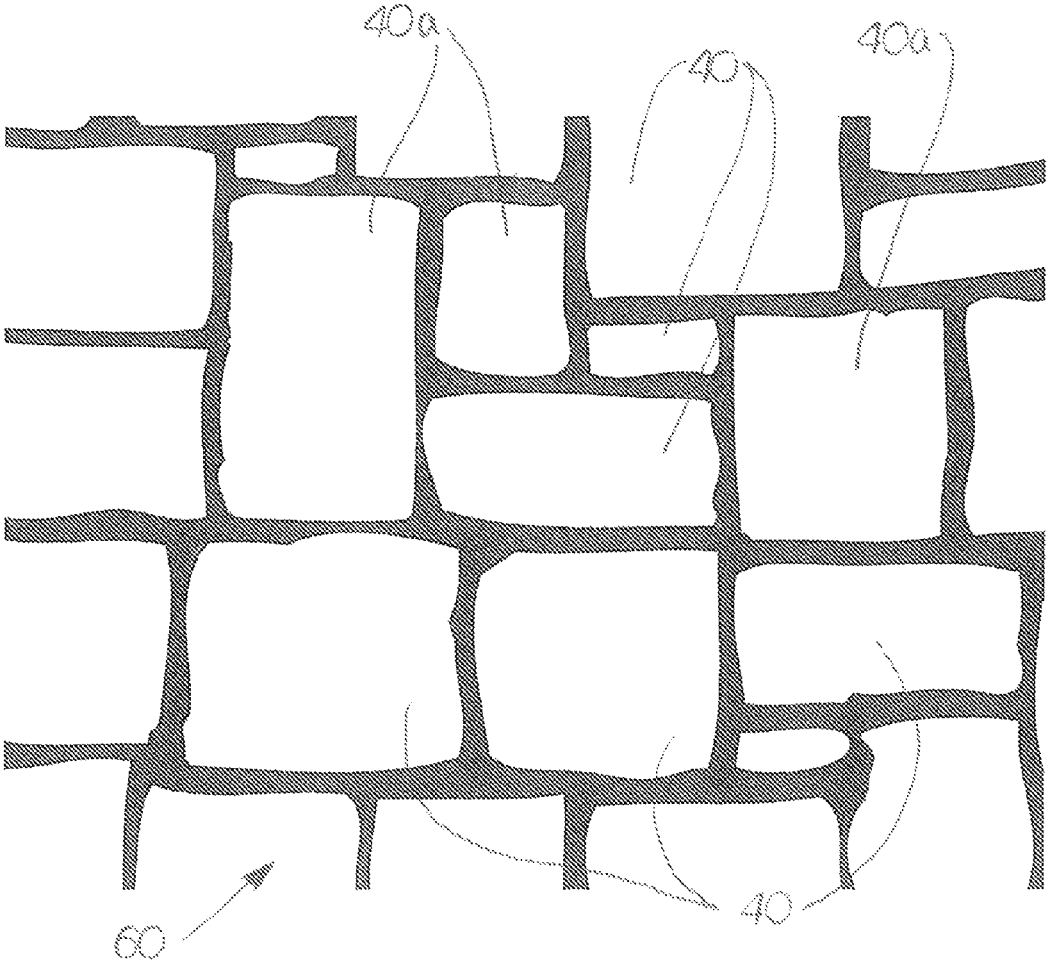
FIG. 28 is a front plan view of another wall assembly of the disclosure including facing blocks of different sizes and different orientations.

FIG. 28 illustrates a wall assembly in accordance with the present disclosure wherein various facing blocks 40 of different size are stacked in a first orientation within the facing wall 60 and a plurality of facing blocks 40*a* of different size are stacked in a second orientation within the facing wall 60. Although the facing blocks 40 and 40*a* in the illustrated embodiment are oriented generally horizontal or generally vertical, blocks of any orientation can be combined, as shown in FIG. 24.

Although trellis panels with perpendicularly intersecting mounting and support members are shown in most of the drawings, wall assemblies are encompassed by the present disclosure, wherein the mounting and support members intersect at angles less than 90 degrees and are oriented at an angle to horizontal and vertical respectively (not shown) in the installed and upright condition of the trellis panel.

Figure 31:
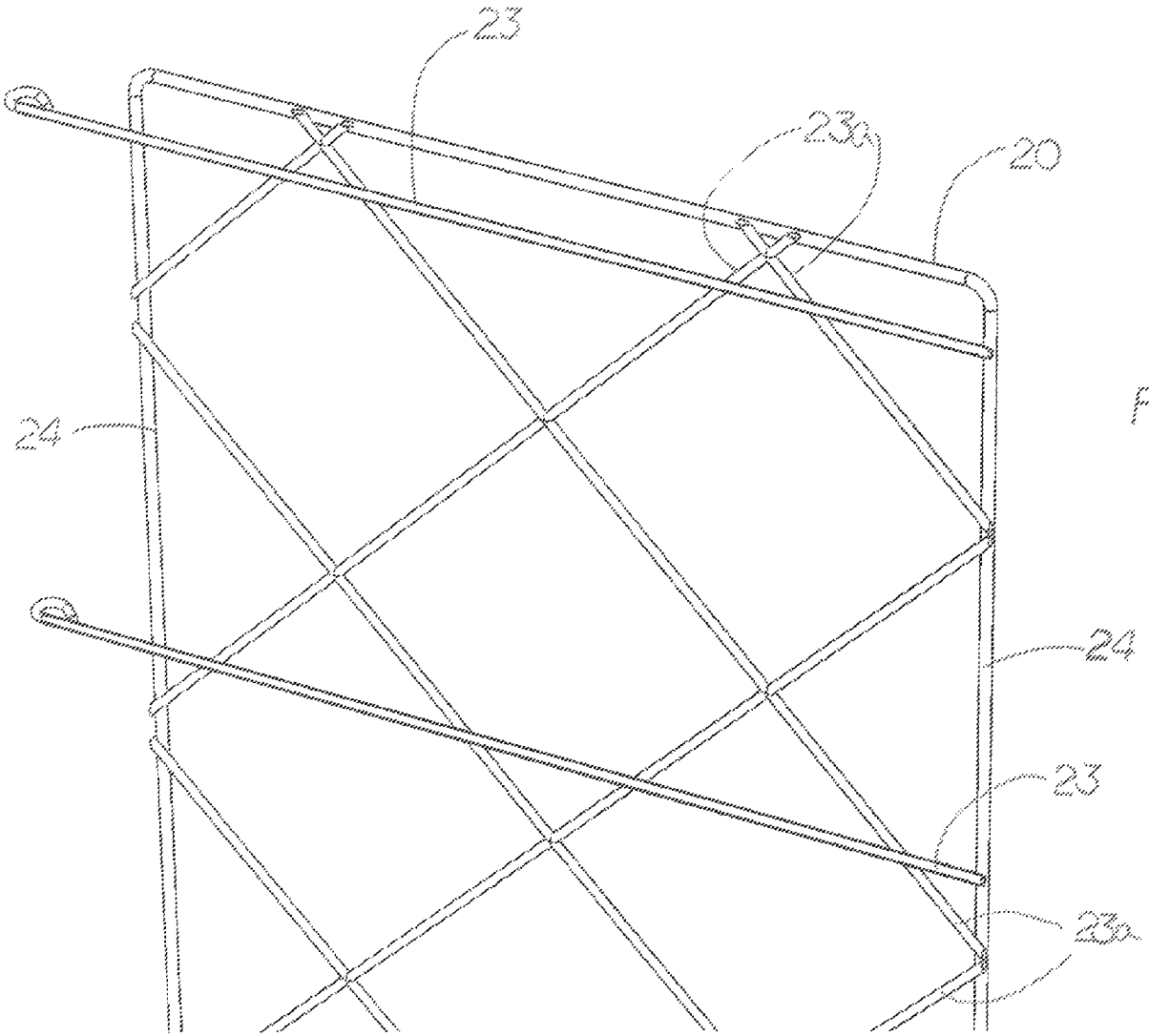
FIG. 31 illustrates a trellis panel with mounting members extending at an angle other than horizontal or vertical and at an angle other than orthogonal to one another.

FIG. 31 illustrates a variant trellis panel 20 in accordance with the present disclosure, wherein the trellis includes mounting members 23 extending perpendicular to the support members 24 as well as angled mounting members 23*a* extending at an angle to the support members 24, and as illustrated, preferably at the same angle upward and downward from horizontal to create intersecting angular mounting members 23*a*, which allow for maximum design flexibility and the highest number of options for attachment of the connectors 80. As is apparent from FIG. 26, the trellis panel 20 of FIG. 31 can be combined with adjustable connectors 80*a* as shown in FIGS. 21A-21C and facing blocks 40 with perpendicular or angled retaining grooves 44.

Figure 32:
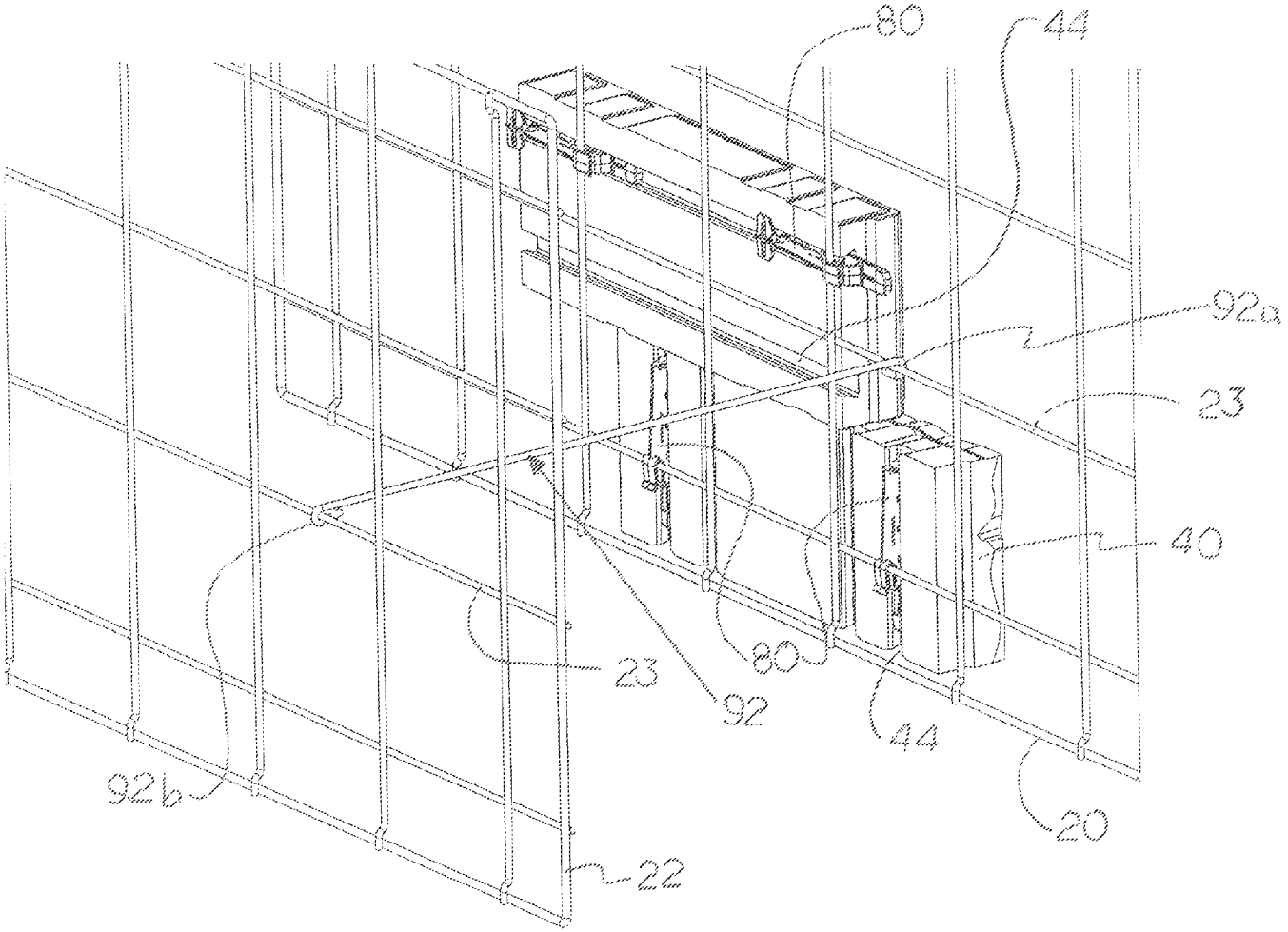
FIG. 32 illustrates a partial view of the illustration of FIG. 26 further including a brace for stabilizing the trellis panel and connecting it to another like wall assembly or a support.

FIG. 32 shows a wall assembly similar to the one illustrated in FIG. 26, but further including a brace 92 which is linked at one end 92*a* with a horizontal mounting member 23 of the trellis panel 20 and at the other end 92*b* with a horizontal mounting member 23 of an additional trellis panel 22 of another like wall assembly. Alternatively, the other end can be linked to any other structural element, such as an existing wall, or a support. Preferably, multiple braces 92 are used to hold a pair of wall assemblies in accordance with the present disclosure in a spaced apart and back-to-back arrangement as illustrated in FIG. 32. This then results in a hollow wall, which can be filled with loose filler material, if desired.

Figure 33:
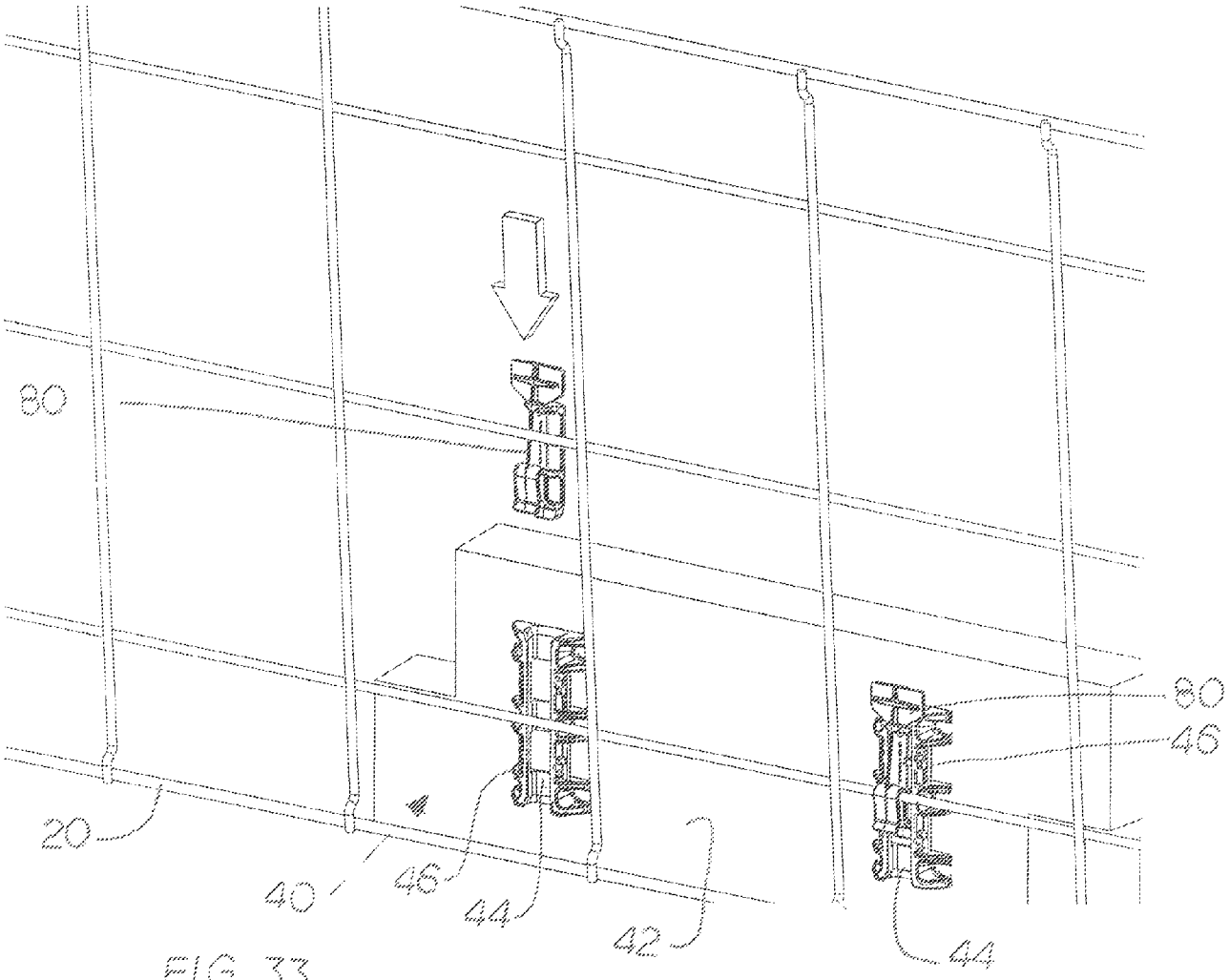
FIG. 33 illustrates the attachment of a facing blocks without retaining grooves.

FIG. 33 shows facing blocks 40 which do not include an integral retaining groove. Instead, a retaining member 46 including a retaining groove 44 is fastened to the rear surface 42 of the facing block 40 by fasteners, or attached by adhesives or the like. The retaining member 46 can be attached to the rear surface by any know means which result in a reliable connection of the retaining member 46 with the rear surface 42. Alternatively, if the facing blocks 40 are wet cast panels, the retaining member 46 may include an anchoring tab (not shown) which is embedded in the block during casting and connect the retaining member 46 to the block. Once the retaining member 46 is attached to the rear surface 42, the facing block 40 can be connected to the trellis panel 20 by a connector 80 in the same manner as facing blocks 40 with integrated retaining slots, by insertion of the connector 80 into the retaining groove 44 in the retaining member 46, as illustrated in FIG. 33. The retaining member 46 can also be attached to articles other than facing blocks 40, namely aesthetic or functional inserts (not shown) made of materials other than stone or concrete and which are inserted into the wall to create a visual appearance different from that of a complete stone wall, or to generate openings in the wall.

Figure 34:
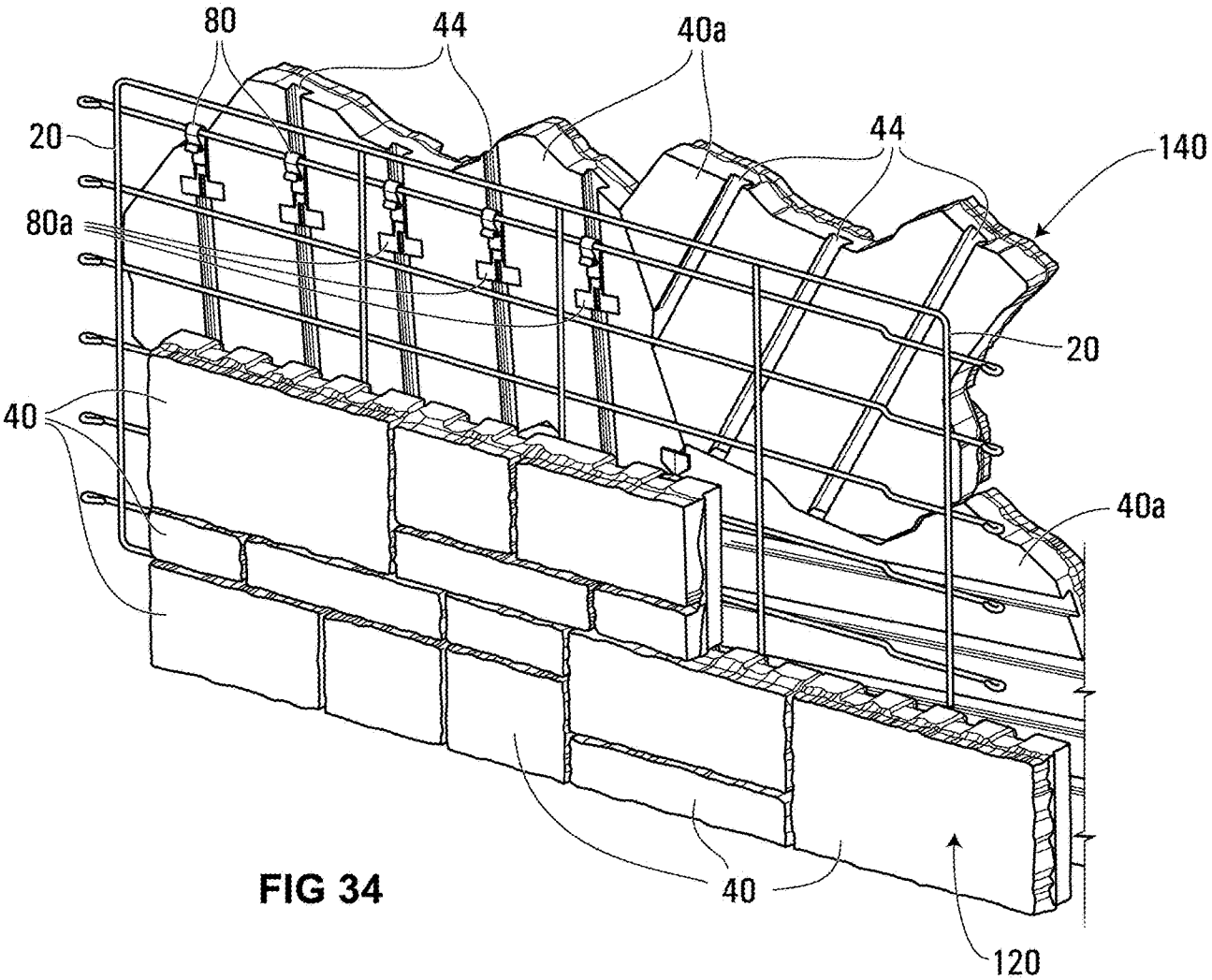
FIG. 34 illustrates a double sided wall with facing blocks of equal size on one side of the trellis combined with facing blocks of different sizes, shapes and orientation placed on the opposite side of the trellis.
Figure 35:
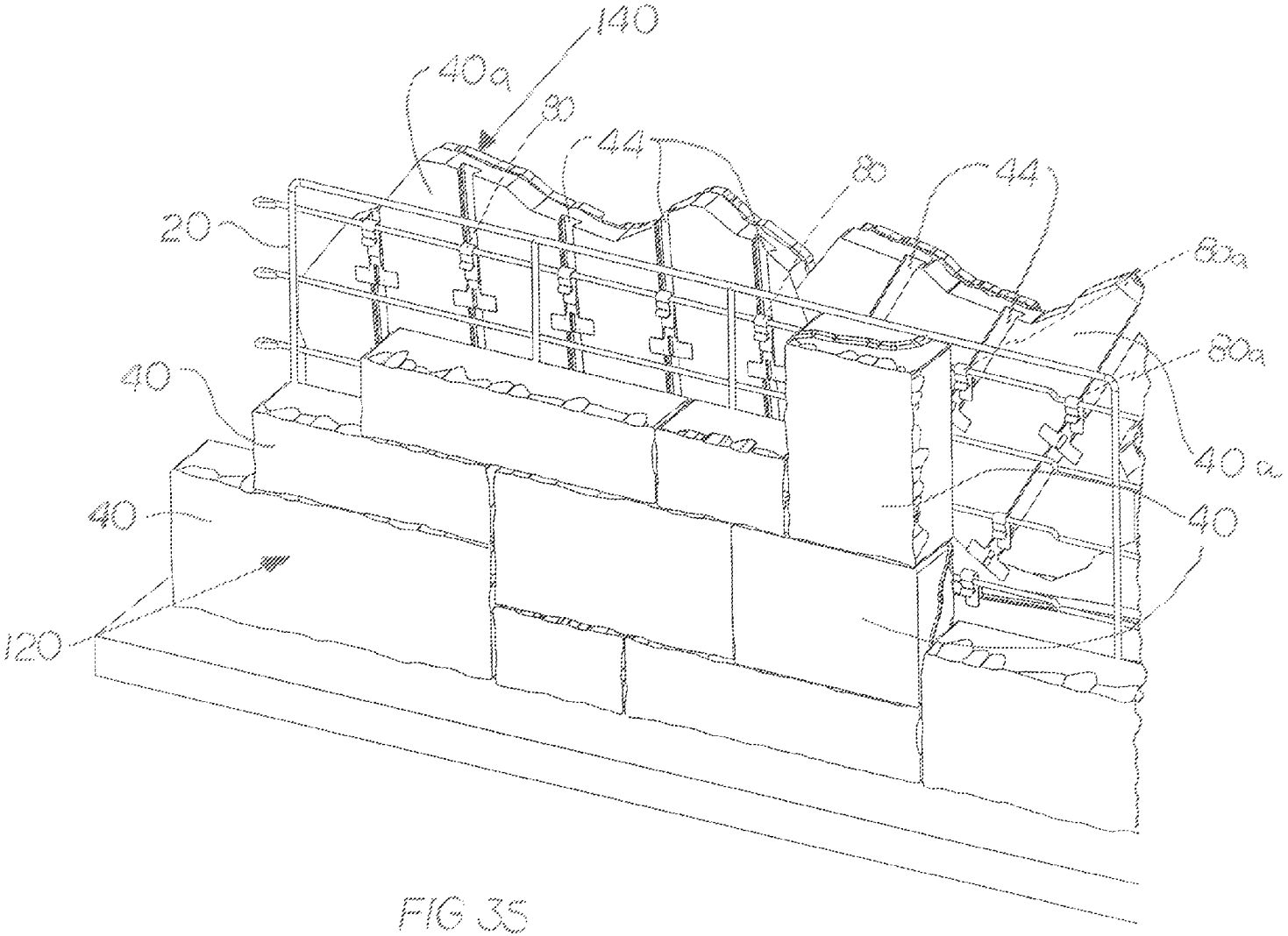
FIG. 35 illustrates a double sided wall with rectangular facing blocks of different size and orientation placed on one side of the trellis and facing blocks of different sizes, shapes and orientation placed on the opposite side of the trellis.

FIG. 34 illustrates a double sided wall with facing blocks 40 of equal size and orientation on one side of the trellis combined with facing blocks 40*a* of different sizes, shapes and orientation placed on the opposite side of the trellis. Double walls of back to back blocks and made with conventional blocks require the exact stacking of the blocks according to a specific pitch or pattern to match the location and orientation of the retaining grooves in the blocks of one wall with those of the other. The use of blocks of different size and shape is extremely difficult. In contrast, by attaching the facing blocks in the wall assembly of the present application to be movable relative to and along the trellis panel and/or the connectors, the options for design and pattern of the wall are vastly increased, since the blocks need not be stacked according to any pitch, or pattern. This allows for the creation of irregular installation patterns which much more closely approximate the appearance of a natural stone wall. As shown in FIG. 34, facing blocks 40 of one size and orientation are stacked on one side of and connected to the trellis panel 20 by connectors 80, while facing blocks 40*a* of completely different size and stacked in varying orientations are stacked within the opposite wall and also connected to the trellis panel 20 by connectors 80, preferably by jointed connectors 80*a*. By using the trellis panel 20 as a bridge between the facing blocks 40, 40*a* in the opposing walls, facing blocks with mismatched pitch, size and orientation and especially facing blocks with retaining grooves 44 mismatched in location and orientation can be combined into a double sided wall without difficulties. As shown in FIG. 35, both sides of the double sided wall can be assembled from facing blocks of different size and shape to create a tessellation pattern in each wall. FIG. 35 illustrates a double sided wall with rectangular facing blocks 40 of different size and orientation placed on one side of the trellis 20 and facing blocks 40*a* of different sizes, shapes and orientation placed on the opposite side of the trellis 20. The orientation of the retaining recesses 44 in the stacked blocks 40 of the first facing wall is mismatched with the orientation of the retaining recesses 44 in the stacked blocks 40*a* of the second facing wall.

Multiple trellis panels 20, or additional trellis panels 22, can be joined end to end by looping hooked ends of the mounting members 23 of one trellis around a support member 24 of an adjacent trellis panel, as shown in FIGS. 9, 10, 17, 22, 29 and 30, or by looping the hooked ends around a vertical portion of a mounting member in an adjacent trellis panel as shown in FIGS. 14 to 16E.

Figure 36:
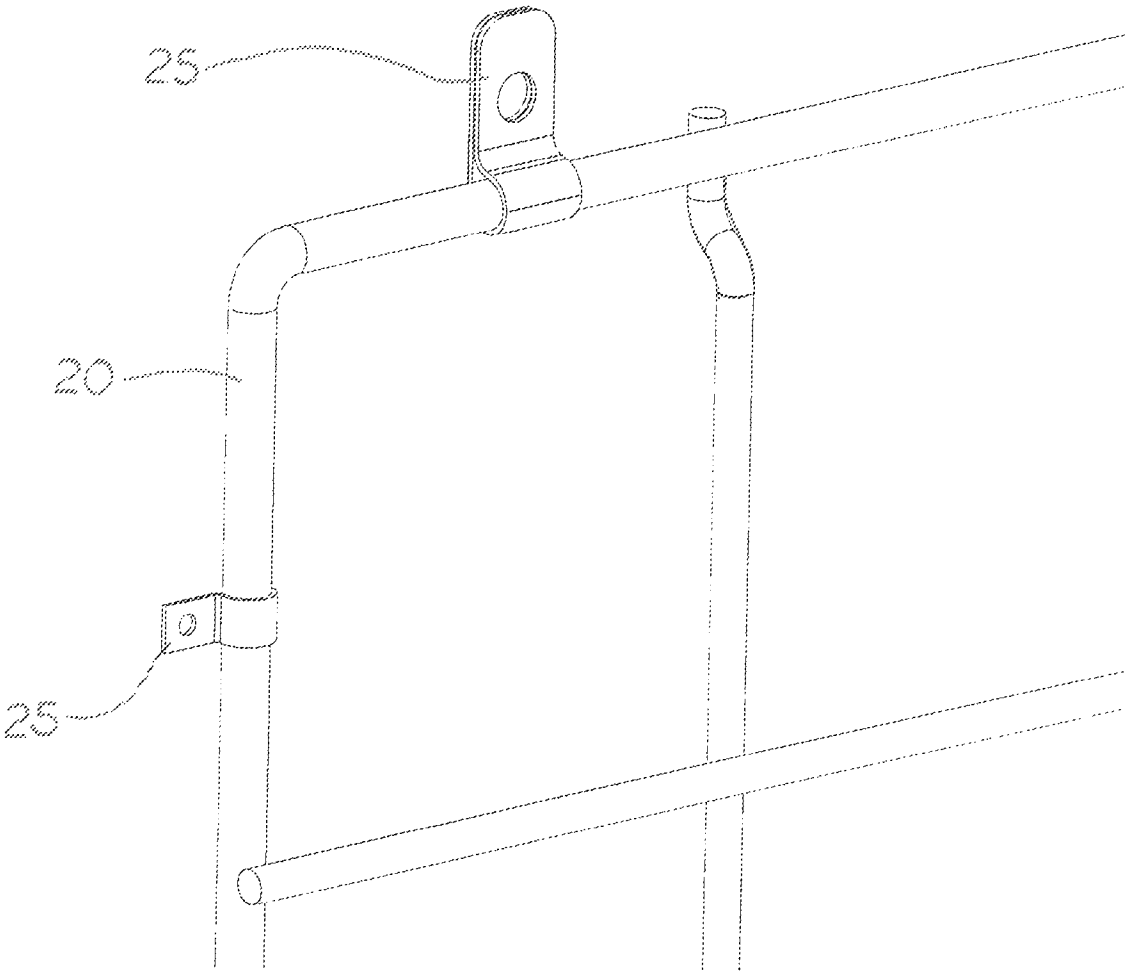
FIG. 36 illustrates a corner portion of a trellis panel with clips for forming connecting links to adjacent trellises, supports, or other supporting structures.
Figure 37:
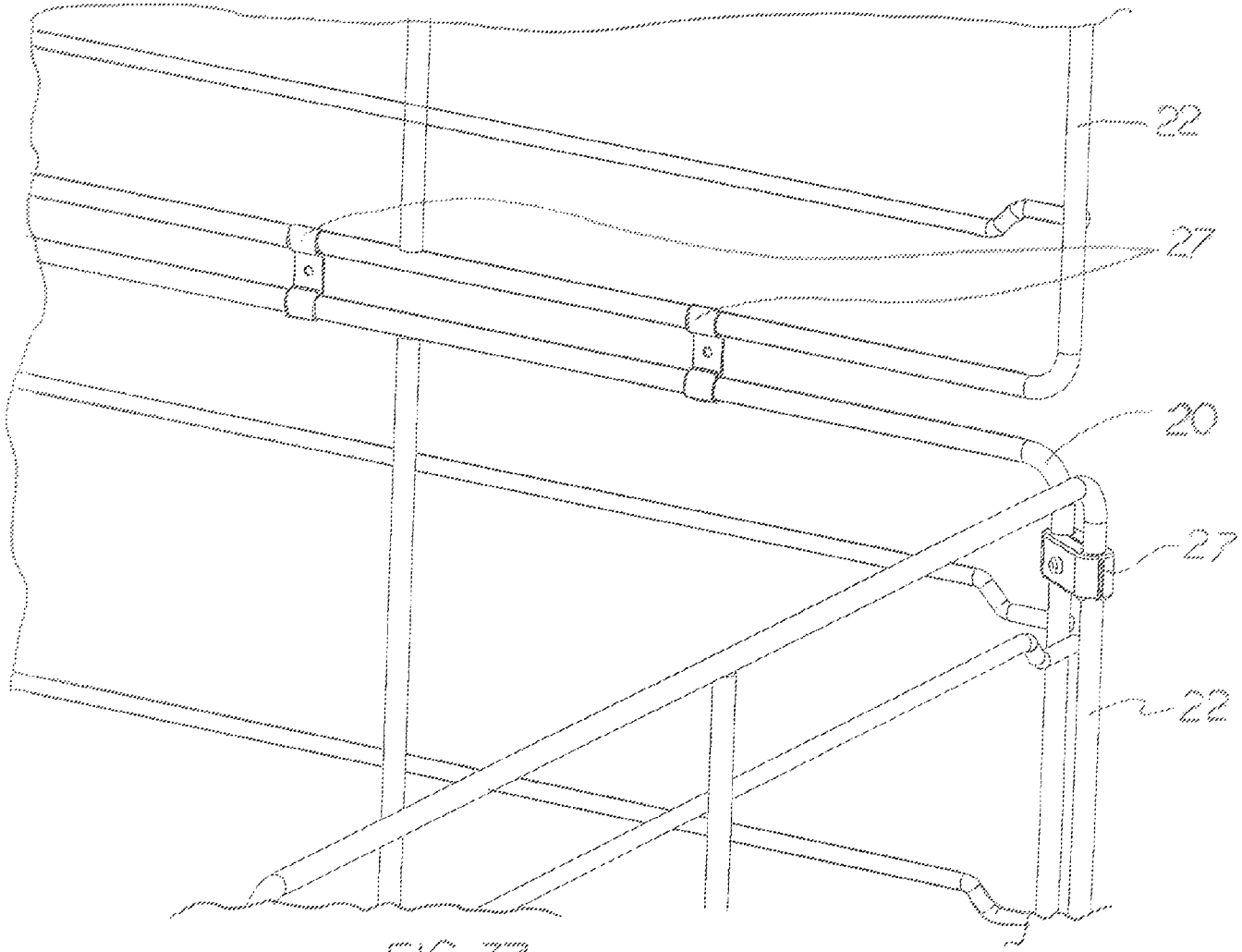
FIG. 37 illustrates a connection of multiple trellis panels for extension of the trellis panel structure vertically and horizontally, the horizontal connection forming a right angle corner.
Figure 38:
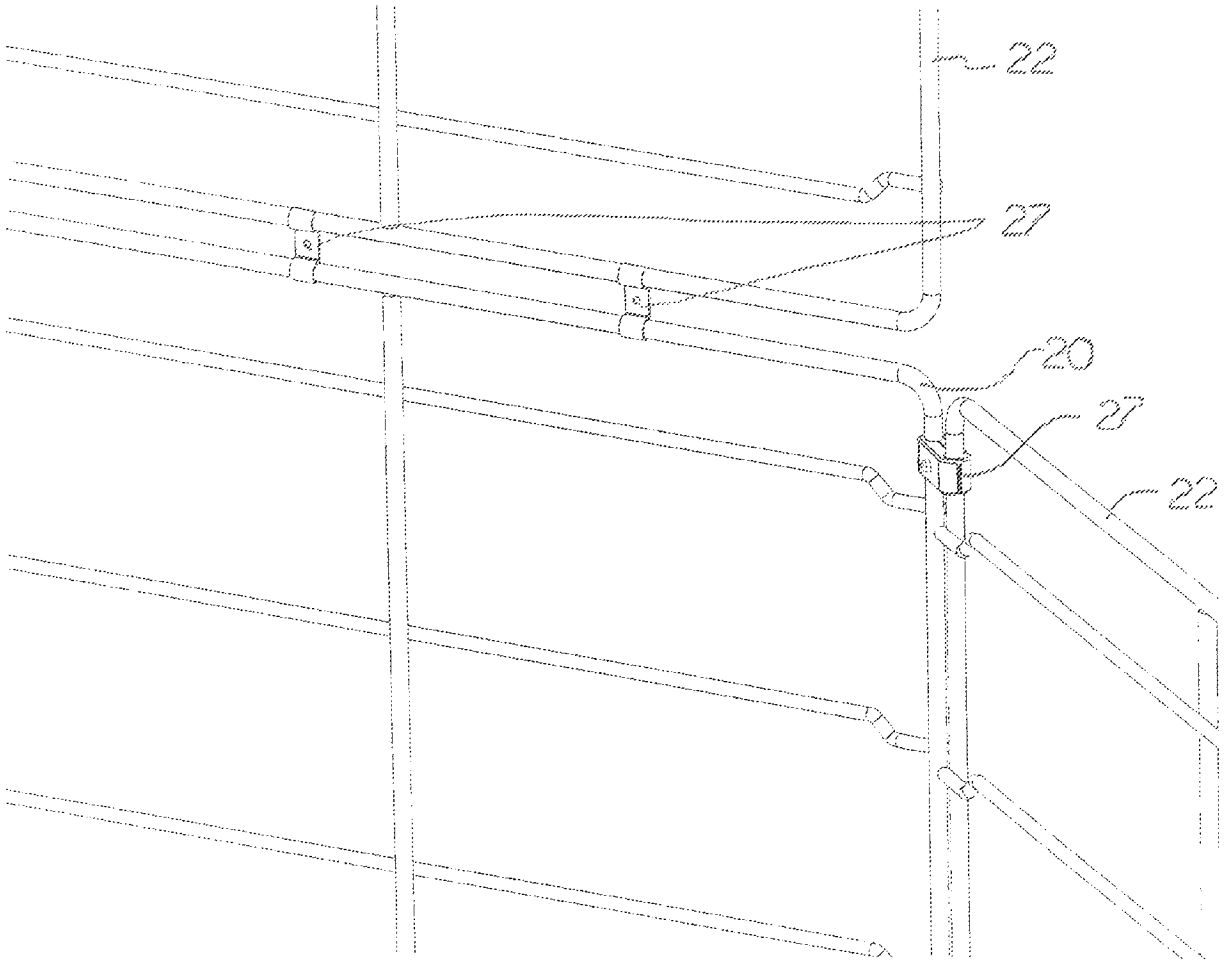
FIG. 38 illustrates a connection of multiple trellis panels for extension of the trellis panel structure vertically and horizontally, the horizontal connection forming a wide angle corner.

The interconnection of adjacent trellis panels 20, 22 can also be achieved with connecting links, such as clips, as shown in FIG. 36, which illustrates a corner portion of a trellis panel 20 with clips 25 for forming connecting links to adjacent trellises or supports. Multiple trellis panels 20, or additional trellis panels 22, can be connected vertically and horizontally as shown in FIG. 37, illustrates connectors 27 that form a connection between the trellis panel 20 and additional trellis panels 22 for extension of the trellis panel structure vertically and horizontally. In the illustrated arrangement, the horizontal connection forms a right angle corner. The connectors 27 may be rigidly attached to the trellis panels 20 and additional trellis panels 22 or movably, the latter permitting adjustment of the alignment of the trellis panel 20 relative to one another. As shown in FIG. 38 the connectors 27 can be used to achieve a connection of multiple trellis panels at any orientation. FIG. 38 illustrates a horizontal connection forming a wide angle corner. By connecting the trellis panels 20 and additional trellis panels 22 at a desired angle, non-liner walls and even curved walls can be created with the assembly of the present application. Shorter trellis panels 20 and additional trellis panels 22 can be used for the achievement of smaller radius curves in the wall.

For ease of manufacture, multiple square blocks of different size can be combined in the same mold pattern, which means the mold layout (not shown) can be optimized for production of the blocks.

Figure 39:
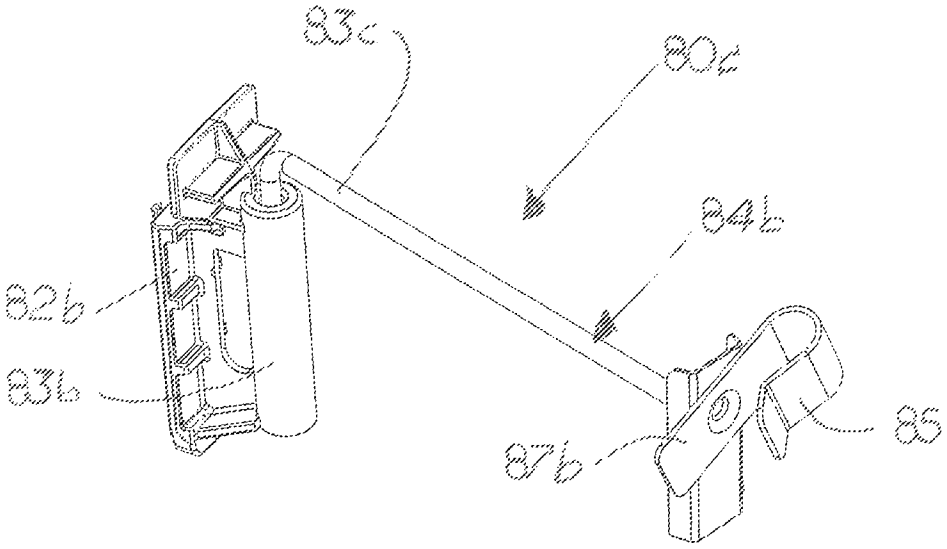
FIG. 39 illustrates a connector with three portions rotatable about axes orthogonal to one another.
Figure 40:
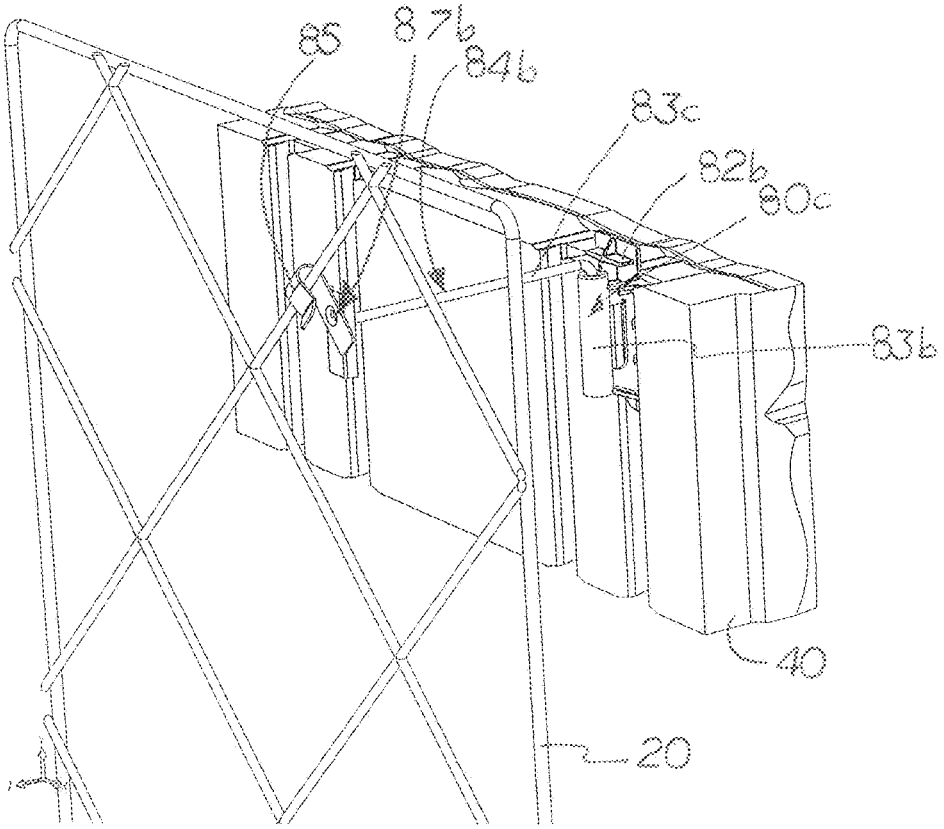
FIG. 40 illustrates the use of the connector shown in FIG. 39 to attach a block to a trellis as shown in FIG. 31.

Although the connection of the blocks to the trellis obviates the need for mortar or cement for structural integrity, it may still be desired to use mortar or grout for aesthetic or sealing purposes. FIG. 39 illustrates another variant connector 80*c*, which is a variant of extended connector 80*b* and includes the retaining portion 82*b* for engagement of the retaining groove of a facing block 40 and an attachment portion 84*b* divided into a fixed section 83*b* integral with the retaining portion 82*b*, a brace portion 83*c* rotatably connected to the fixed section 83*b* for rotation about a first axis of rotation parallel to an axis of the retaining portion 82*b* and a rotatable portion 87*b*, including the snap-on hook 85 and rotatably connected with the brace portion 83*c* for rotation about a second axis of rotation orthogonal to the first axis of rotation. The connector 80*c* with the three portions that are rotatable relative to one another about orthogonal axes of rotation facilitates the assembly of hollow double walls, wherein the facing blocks 40 of one side are mismatched in size, orientation, pitch and/or retaining groove orientation with the facing blocks 40*a* of the other side. This is more easily understood from the drawing of FIG. 40, which illustrates the use of the connector shown in FIG. 39 to attach a block to a trellis as shown in FIG. 31.

Figure 41:
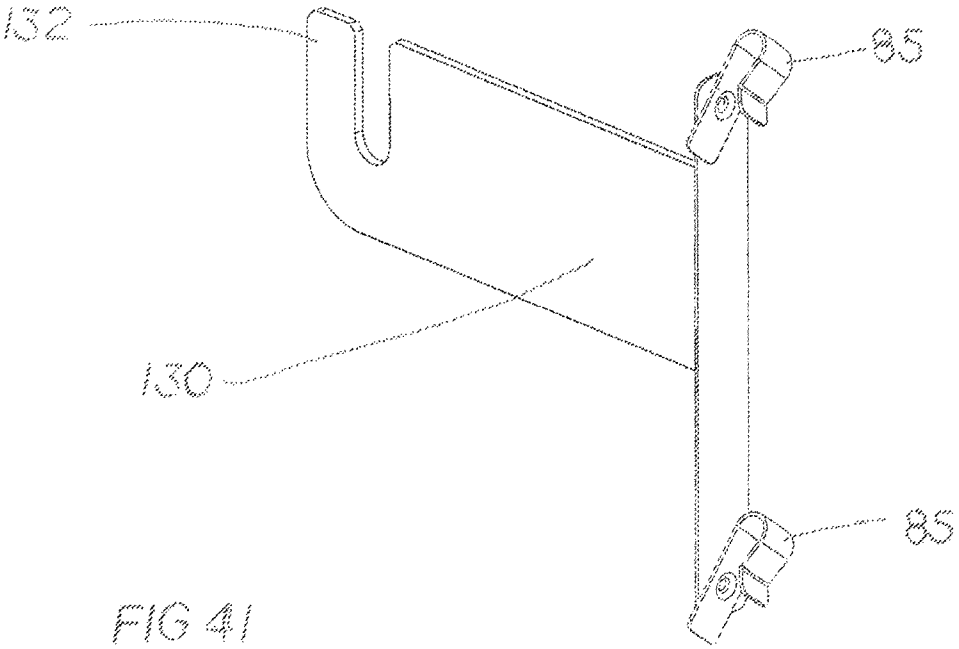
FIG. 41 illustrates a hanger for mounting on the trellis and incorporation into a stacked wall.
Figure 42:
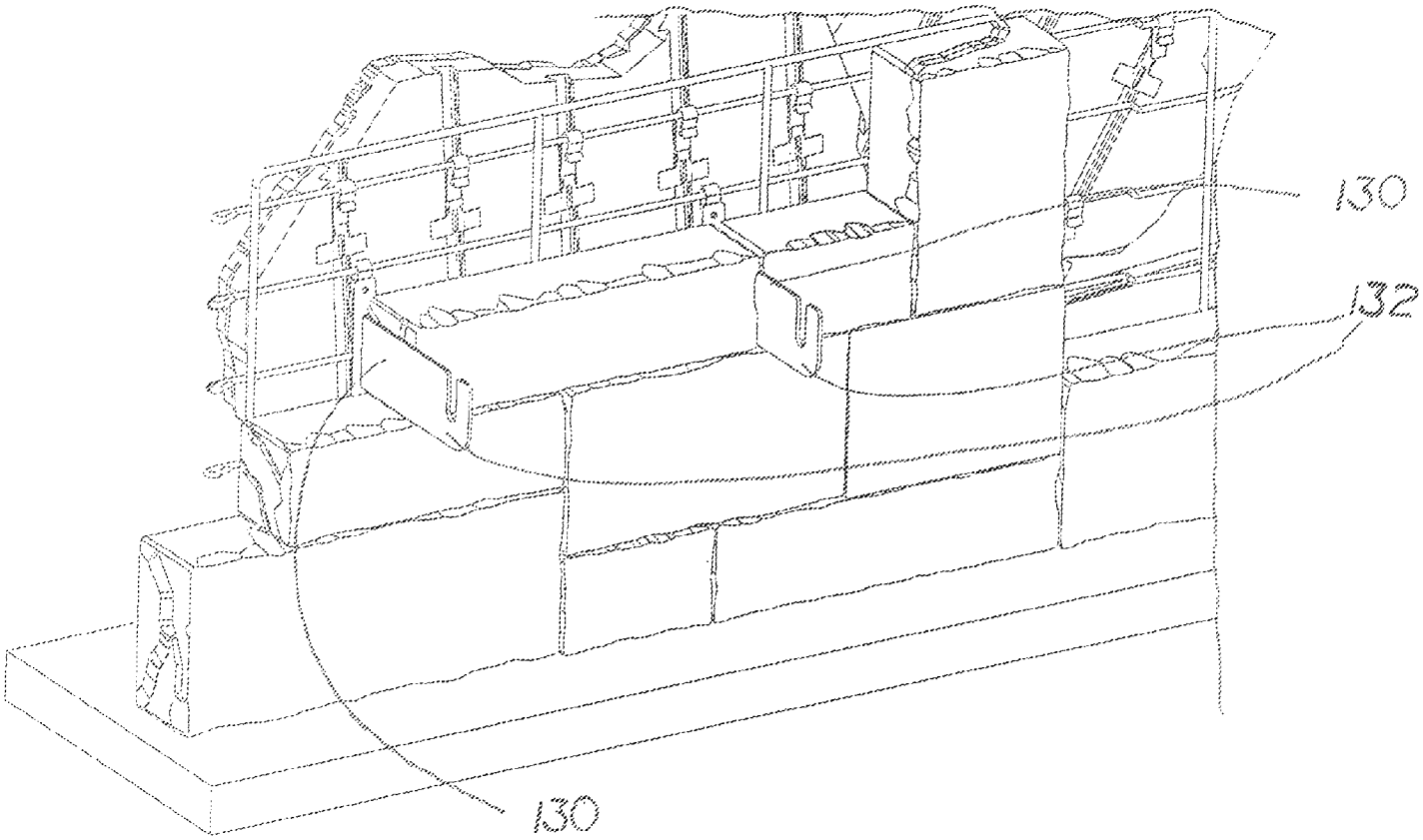
FIG. 42 illustrates the hanger of FIG. 41 incorporated into the wall of FIG. 35.

FIG. 41 illustrates a hanger 130 for mounting on the trellis 20. The hanger includes snap on hooks 85 for connection to the trellis panel 20, as illustrated in FIG. 42, which illustrates the hanger 130 in the installed condition and incorporated into the wall of FIG. 35. The hanger 130 further has a hooked supporting end 132, which in the installed condition protrudes from the wall. Once installed, the hanger 130 can be used to support wall decorations, for example flower pots. A pair of hangers 130 can be used, as shown in FIG. 42 to support elongated objects in a horizontal position, for example a shelf like structure.

What is claimed is:

1. A wall assembly, comprising a facing wall;

a trellis panel for providing the facing wall with structural integrity and having front and back sides, lateral ends and a top end;

a support connected to the trellis panel for holding the trellis panel in an upright orientation;

the facing wall being located on one of the front and back sides of the trellis panel and including a plurality of stacked facing blocks and a plurality of connectors, a rear surface of each facing block being connected to the trellis panel by a spaced apart pair of the connectors for maintaining the facing wall upright;

each connector extending between one stacked facing block and the one of the front and back sides of the trellis panel to connect the facing wall only to the trellis panel and for allowing shifting of the stacked facing blocks within the facing wall; and the support being connected to the trellis panel at the top edge for the trellis panel to prevent buckling or leaning of the facing wall.

2. The wall assembly of claim 1, wherein each connector is movably connected to at least one of the trellis panel and the facing block to allow shifting of the blocks within the wall without buckling or leaning of the wall.

3. The wall assembly of claim 1, wherein the support is one or more vertical posts respectively connected to one of the lateral ends and at the top end.

4. The wall assembly of claim 1, wherein the trellis panel includes an open framework or lattice of intersecting members.

5. The wall assembly of claim 4, wherein the intersecting members are oriented horizontally and vertically when the trellis panel is in the upright orientation.

6. The wall assembly of claim 5, wherein the intersecting members are vertical rails and horizontal connecting rods.

7. The wall assembly of claim 5, wherein the intersecting members are horizontal and vertical rods.

8. The wall assembly of claim 4, wherein the intersecting members are made of metal provided with a corrosion resistant finish.

9. The wall assembly of claim 1, further comprising at least one additional trellis panel connected end-to-end with the first trellis panel for forming a straight wall or at an angle with the first trellis panel for forming an angled or curved wall.

10. The wall assembly of claim 9, wherein at least two additional trellis panels are respectively connected with opposite ends of the trellis panel and together with the trellis panel form an upstanding polygonal structure.

11. The wall assembly of claim 1, wherein the facing blocks are stacked on both sides of the trellis panel to provide a double sided wall made of a pair of facing walls respectively connected only with the trellis panel.

12. A double sided retaining wall or freestanding wall, comprising a first facing wall;

a second facing wall;

a trellis panel for providing the first and second facing walls with structural integrity and having front and back sides, lateral ends and a top end; and a support for maintaining the trellis panel in an upright orientation;

the first facing wall being located on the front side of the trellis panel and including a plurality of stacked first facing blocks and a plurality of first connectors, a rear surface of each first facing block being connected to the trellis panel by a spaced apart pair of the first connectors for maintaining the first facing wall upright;

the second facing wall being located on the back side of the trellis panel and including a plurality of stacked second facing blocks and a plurality of second connectors a rear surface of each second facing block being connected to the trellis panel by a spaced apart pair of the second connectors for maintaining the second facing wall upright; and wherein each first connector extends between one stacked first facing block and the front side of the trellis panel to connect the first facing wall only to the trellis panel for allowing shifting of the stacked first facing blocks within the first facing wall independent of the second facing blocks in the second facing wall and each second connector extends between one stacked second facing block and the back side of the trellis panel to connect the second facing wall only to the trellis panel for allowing shifting of the stacked second facing blocks within the second facing wall independent of the first facing blocks in the first facing wall.

13. The double sided wall of claim 12, wherein the first and second facing blocks have a rear surface and a pair of retaining recesses in the rear surface, each for engagement by one of the first and second connectors.

14. The wall assembly of claim 1, wherein each facing block has a pair of retaining elements in the back surface and the first and second connectors each have a retaining member for interlocking engagement with one of the retaining elements in the first and second facing blocks.

15. The wall assembly of claim 9, wherein the trellis panel and the at least one additional trellis panel are foldably interconnected for placement in a straight line or at an angle to one another.

16. The wall assembly of claim 15, including the trellis panel and three additional trellis panels connected in series to form an upstanding structure of square, rectangular or diamond shaped cross-section for filling with loose filler material to form a vertically upstanding structure, such as a column or post.

17. The wall assembly of claim 1, wherein the support is an existing upstanding structure having a facing surface and the trellis panel is attached to the facing surface for the wall assembly providing a new facing on the upstanding structure.

18. The wall assembly of claim 17, wherein the upstanding structure is a building wall.

19. The wall assembly of claim 1, wherein the support is formed by one or more additional and like trellis panels respectively foldably connected to the lateral ends and the top end of the trellis panel for placement of the trellis panel and additional trellis panels in the shape of a multisided, closed upstanding structure, wherein the front sides of the trellis panel and additional trellis panels face to an outside of the closed structure and the plurality of facing blocks is stacked into a facing wall on each of the front sides to form a column or post with facing walls.

20. The wall assembly of claim 19, wherein the column or post further comprises a fill of loose filler material filling a space delimited by the back sides of the trellis panel and additional trellis panels.

* * * * *